US012351286B1

(12) United States Patent
Hopkins

(10) Patent No.: US 12,351,286 B1
(45) Date of Patent: Jul. 8, 2025

(54) INFLATABLE OAR FRAME FOR A WATERCRAFT

(71) Applicant: Ideal, LLC, Asheville, NC (US)

(72) Inventor: William Lucas Hopkins, Asheville, NC (US)

(73) Assignee: Ideal LLC, Asheville, NC (US)

( * ) Notice: Subject to any disclaimer, the term of this patent is extended or adjusted under 35 U.S.C. 154(b) by 0 days.

(21) Appl. No.: 19/029,048

(22) Filed: Jan. 17, 2025

(51) Int. Cl.
*B63H 16/06* (2006.01)
*B63B 7/08* (2020.01)
*B63H 16/02* (2006.01)

(52) U.S. Cl.
CPC ..... *B63H 16/06* (2013.01); *B63B 7/085* (2013.01); *B63H 16/02* (2013.01)

(58) Field of Classification Search
CPC .. B63H 16/02; B63H 16/06; B63H 2016/063; B63B 7/085; B63B 34/22
USPC ..... 114/345; 440/108
See application file for complete search history.

(56) References Cited

U.S. PATENT DOCUMENTS

| | | | | |
|---|---|---|---|---|
| 9,126,655 | B2 * | 9/2015 | Swan | B63B 32/51 |
| 2002/0073909 | A1 * | 6/2002 | Liston | B63B 7/082 114/345 |
| 2006/0094313 | A1 | 5/2006 | Rotchy | |
| 2014/0245943 | A1 * | 9/2014 | Swan | B63B 32/40 114/345 |
| 2015/0336634 | A1 * | 11/2015 | Swan | B63H 16/06 114/364 |
| 2024/0008468 | A1 * | 1/2024 | Thomas | A01K 97/10 |

OTHER PUBLICATIONS

Outdoorplay. NRS Approach 100 Fishing Raft Rower's Package. Website, https://www.outdoorplay.com, originally downloaded Jan. 17, 2025, 4 pages.

* cited by examiner

*Primary Examiner* — Daniel V Venne
(74) *Attorney, Agent, or Firm* — Craig R. Miles; CR MILES P.C.

(57) ABSTRACT

An inflatable oar frame and methods of making and using an inflatable oar frame adapted to removably mount over a watercraft interior, wherein oar towers can couple to the inflatable oar frame to provide an interface between the oars and the watercraft.

20 Claims, 21 Drawing Sheets

INFLATABLE OAR FRAME FOR A WATERCRAFT

I. FIELD OF THE INVENTION

An inflatable oar frame and methods of making and using an inflatable oar frame adapted to removably mount over a watercraft interior, wherein oar towers can couple to the inflatable oar frame to provide an interface between the oars and the watercraft.

II. BACKGROUND OF THE INVENTION

Inflatable watercraft can be constructed of flexible tubes which are inflated with air or another gas. Oars can be a means of propulsion for inflatable watercraft. Oars interface with the inflatable watercraft through a rigid metallic frame secured to the inflatable watercraft called an "oar frame". Oars connect to the oar frame via oar towers coupled on either side of the oar frame.

Due to the inconvenience of removing the rigid metallic oar frame from the inflatable watercraft and disassembly of the oar frame into corresponding oar frame parts, once the oar frame is assembled and secured to the inflatable watercraft, the oar frame typically remains secured to the inflatable watercraft and is transported on a trailer. Typically, the trailer will have a 10 foot to 20 foot long deck and a width of 7 foot to 8 foot and weight of 500 pounds to 1500 pounds. The trailer can cost about US$3,000.00 to US$5,000.00. Moreover, the trailer requires trailer parking space and the inflated watercraft secured to the oar frame requires watercraft storage space unless the oar frame is disassembled and the watercraft deflated.

There would be a substantial advantage in an inflatable oar frame to which oar towers removably couple to provide the interface between the oars and the inflatable watercraft. The inflatable watercraft and inflatable oar frame can be transported in a deflated and folded condition and readily inflated at the location of use and deflated subsequent to use obviating the need for the trailer, trailer parking space and watercraft storage space along with the associated expense.

III. SUMMARY OF THE INVENTION

Accordingly, a broad object of particular embodiments of the invention can be to provide an inflatable oar frame comprising an inflatable oar frame body adapted to mount over a watercraft interior, the inflatable oar frame body having a top face opposite a bottom face extending to an inflatable oar frame body periphery, wherein the inflatable oar frame body adapted to couple to a first oar tower substantially athwart a second oar tower. A first oar and a second oar can be correspondingly coupled to the first oar tower and the second oar tower. A rower can sit on the top face of the inflatable oar frame body to operate the oars to move the watercraft through the water. In particular embodiments, the inflatable oar frame body can include passthrough open between the top face and the bottom face of the inflatable oar frame body through which the rower's legs can pass into the watercraft interior to engage the rower's feet with a foot plate.

Another broad object of particular embodiments of the invention can be to provide a method of making an inflatable oar frame comprising adapting an inflatable oar frame body to mount over a watercraft interior, the inflatable oar frame body having a top face opposite a bottom face extending to an inflatable oar frame body periphery, wherein the inflatable oar frame body is configured to couple to a first oar tower substantially athwart a second oar tower. Coupling a first oar to the first oar tower and coupling a second oar to the second oar tower. Disposing a passthrough between the top face and the bottom face of the inflatable oar frame body. Disposing a seat portion on the top face of the inflatable oar frame body adjacent the passthrough and medially between said first oar tower and said second oar tower, wherein the passthrough is configured to allow a rower's legs to pass into the watercraft interior of said watercraft while positioned on the seat portion.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
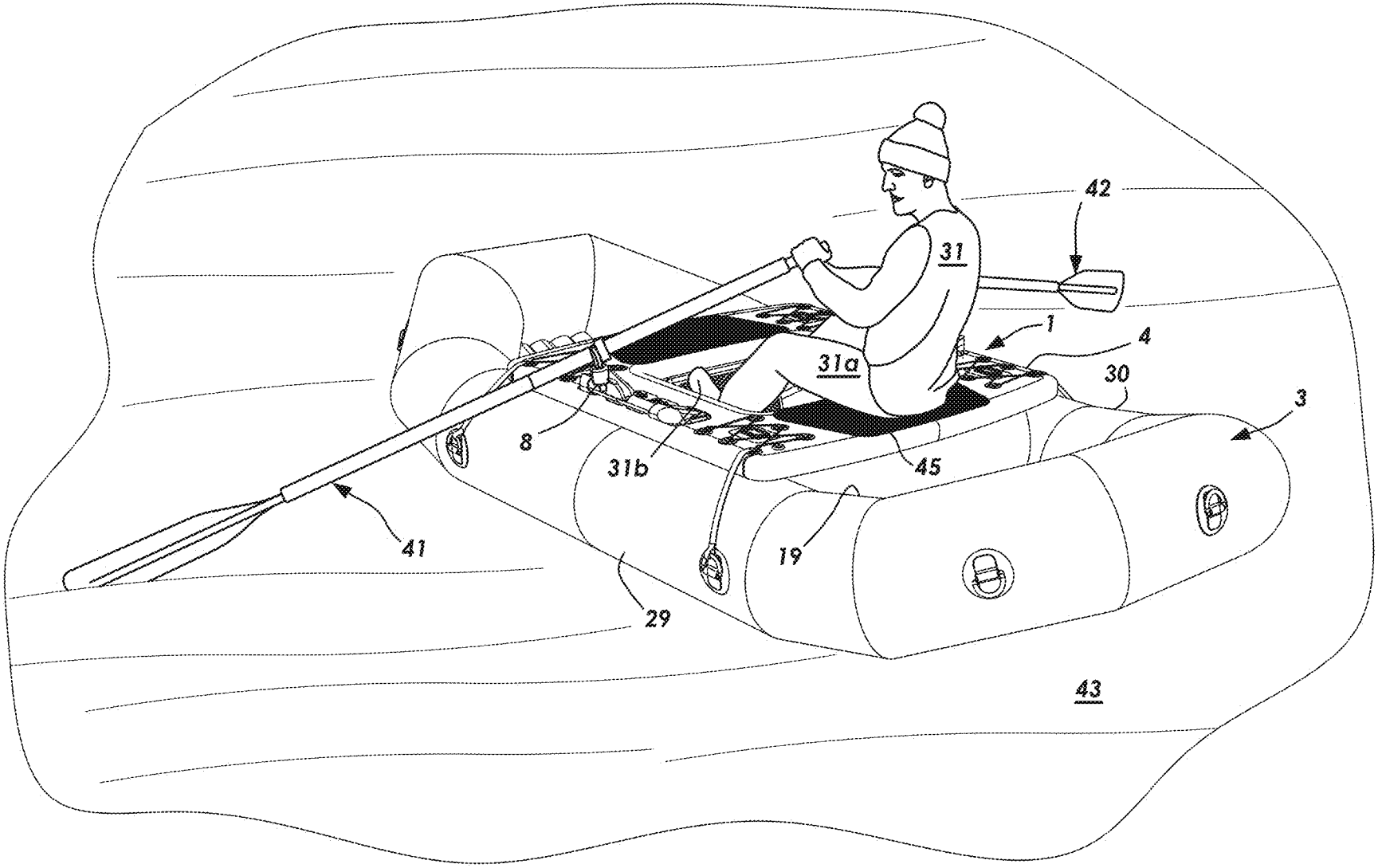
FIG. 1 is an illustration depicting a method of using a particular embodiment of the inventive inflatable oar frame secured to a watercraft.

Generally, referring to FIGS. 1 through 8G, which depict embodiments of an inflatable oar frame (1) and methods of making and using embodiments of an inflatable oar frame (1) adapted to or configured to mount over a watercraft interior (2) of a watercraft (3). As to particular embodiments, the inflatable oar frame (1) can include an inflatable oar frame body (4) having a top face (5) opposite a bottom face (6) extending to an inflatable oar frame body periphery (7), wherein the inflatable oar frame body (4) is adapted to or configured to couple to a first oar tower (8) substantially athwart a second oar tower (9).

Now, with primary reference to FIGS. 2A through 6B, embodiments of the inflatable oar frame body (4) can comprise top face fabric material (10) and a bottom face fabric material (11) extending to adhered overlapping fabric periphery margins (12) to define one or more inflatable airtight interior chamber(s) (13) (as depicted in the Figures by the broken line and circle). The fabric material (10, 11) can be any flexible material that can delimit the inflatable airtight interior chamber(s) (13) and afford a waterproof external surface (14) of the inflatable oar frame body (4). As illustrative examples, the flexible materials can include a natural rubber, a synthetic rubber (such as, a polybutadiene, a polyisoprene, a polysiloxane, a polyvinyl chloride, neoprene) and other synthetic polymers (such as a chlorosulfonated polyethylene, polypropylene, nylon, polystyrene), and combinations thereof.

Again, with primary reference to FIGS. 2A through 6B, in particular embodiments, the top face fabric material (10) and a bottom face fabric material (11) of the inflatable oar frame body (4) can be made using a drop stitch material. Drop stitch material can be produced by the drop stitch method, in which two or more fabric webs, such as, denier polyester fabric webs, are separate but joined by a plurality of polyester threads. The two fabric webs maintain a distance from each other so that the space filled with polyester threads between the fabric webs can later be filled with air or other gas. The drop stitch material affords substantial mechanical strength upon inflation. The two interconnected fabric webs can be cut to delimit the top face fabric material (10) and a bottom face fabric material (11) of the inflatable oar frame body (4) including the fabric periphery margins (12) which can be overlappingly adhered to afford an airtight inflatable oar frame body (4). The overlapping fabric periphery margins (12) can be adhered together by stitching, waterproof adhesive (such as, an epoxy, a polyurethane, a polyimide, a cyanoacrylate), thermal bonding or welding, radio frequency welding, lamination, zipper, and combinations thereof. The top face fabric material (10) and bottom face fabric material (11) of the oar frame body (4) can be overlaid with additional fabric layers (15) to confer additional strength, rigidity, or texture to the top face fabric material (10) and bottom face fabric material (11). An illustrative example of the additional fabric layers (15) can comprise fabric layers coated with a synthetic plastic such as a vinyl, a polyvinylchloride, a polyester, a polyurethane, a silicone, and combinations thereof.

Again, with primary reference to FIGS. 2A through 6B, the inflatable oar frame body (4) can include an inflation/deflation valve (16) which in the open condition allows air or other gas (17) to flow into or flow out of the interior chamber(s) (13) and in the closed condition prevents air or other gas (17) from flowing out the interior chamber(s) (13) to maintain an operable configuration of the oar frame body (4). A wide variety of inflation/deflation valves (16) can be utilized with embodiments of the inflatable oar frame body (4). The inflation/deflation valve (16) may be a valve which has two positions-one which allows the oar frame body (4) to be inflated and one which allows the oar frame body (4) to be deflated when the inflatable oar frame body (4) is not in use. The inflation/deflation valve (16) can be configured to sealably engage the fabric material (10,11) of the inflatable oar frame body (4). The inflation/deflation valve (16) can be configured for use with manual or electric pumps. According to embodiments, the inflation/deflation valve (16) may be any suitable valve used for inflatable watercraft (3). As illustrative examples, a Halkey Roberts valve (H-valve), a Leafield valve, a Maravia valve, a Military valve, a Boston valve, and Bravo 2005 push-push valve.

Again, with primary reference to FIGS. 2A through 6B, embodiments of the inflatable oar frame body (4) can further include a pressure relief valve (18). As an illustrative example, the pressure relief valve (18) used on inflatable watercraft (3) can be a Leafield A6 pressure relief valve (Leafield Marine Ltd., Atworth, UK). The pressure relief valve (18) can be configured to release air or other gas (17) from the interior chamber (14) at a specified pressure, either due to overinflation, increase in temperature, or compression of the oar frame body (4), or other causes. The inflation/deflation valve (16) and pressure relieve valve (18) can be integral or separate valves that can be disposed at any position on the inflatable oar frame body (4).

Embodiments of the inflatable oar frame body (4), with or without the pressure relief valve (18), can be inflated to a pressure sufficient to obtain an operable configuration of the oar frame body (4). According to embodiments, the oar frame body (4) can be inflated to a specified pressure between about 5 pounds per square inch to about 25 pounds per square inch (psi). Depending upon the application, the pressure can be selected from the group consisting of: 5 psi, 6 psi, 7 psi, 8 psi, 9 psi, 10 psi, 11 psi, 12 psi, 13 psi, 14 psi, 15 psi, 16 psi, 17 psi, 18 psi, 19 psi, 20 psi, 21 psi, 22 psi, 23 psi, 24 psi, 25 psi, 26 psi, 27 psi, 28 psi, and 30 psi. Typical pressures for an inflatable oar frame body (4) made from drop stitch material are between about 10 psi to about 25 psi. Thus, when the inflatable oar frame body (4) includes a pressure relief valve (18), the maximum inflation pressure of the oar frame interior chamber (13) can be capped at any of these specified pressures.

Again, with primary reference to FIGS. 2A through 6B, in particular embodiments, the flexible materials (10, 11) can be cut and fabric periphery margins (12) overlappingly adhered to provide an inflatable oar frame body (4) that upon inflation extends to an inflatable oar frame body periphery (7) configured to be disposed over the watercraft interior (2) of a watercraft (3). In particular embodiments, the inflatable oar frame (4) can be supported by the gunwale (19) of the watercraft (3). The inflatable oar frame body (4) disposed over the watercraft interior (2) and/or supported by the gunwale (19) of the watercraft (3) can be secured to a watercraft (3).

The term "watercraft (3)" means a vessel that can travel on water, and without sacrificing the breadth of the foregoing, includes inflatable and non-inflatable partially open or fully open hull vessels, and as examples include: dories, pontoon boats, john boats, inflatable dinghies, inflatable catamarans, inflatable canoes, inflatable kayaks, and inflatable rafts. The illustrative examples of FIGS. 1, 2A, 3A and 4A depict embodiments of the inventive inflatable oar frame (1) disposed over and secured to an inflatable raft; however, this is not intended to limit the types of watercraft (3) to which embodiments of the inflatable oar frame (1) can be secured; rather these examples are intended to depict a method of using the inflatable oar frame (1) sufficient to allow a person of ordinary skill in the to make and use embodiments of the inflatable oar frame (1) for use with a wide variety of watercrafts (3).

Now, with primary reference to FIGS. 2A-2C, 3A-3C, 4A-4C, 5A-5G and 6A-6B, in particular embodiments, the inflatable oar frame body (4) can have a top face (5) adapted to or configured to couple to a first oar tower (8) substantially athwart a second oar tower (9). A first oar tower (8) can be coupled to the top face (5) of the inflatable oar frame body (4) substantially athwart a second oar tower (9) coupled to the top face (5) of the inflatable oar frame body (4). Oar towers (8, 9) can be obtained in a wide variety of structural configurations, and the top face (5) of the inflatable oar frame body (4) can have a corresponding wide variety of structural configurations that mateably couple directly or indirectly to an oar tower (8, 9). Illustrative examples of the structural configurations of the inflatable oar frame body (4) useful in coupling to an oar tower (8 or 9) include one or more of: pockets in which an oar tower base inserts, open sided channels into which an oar tower base slidingly mates, tabs that overlap the oar tower base, oar tower plates having a fastener pattern that matches the fastener pattern of the oar tower.

Figure 2A:
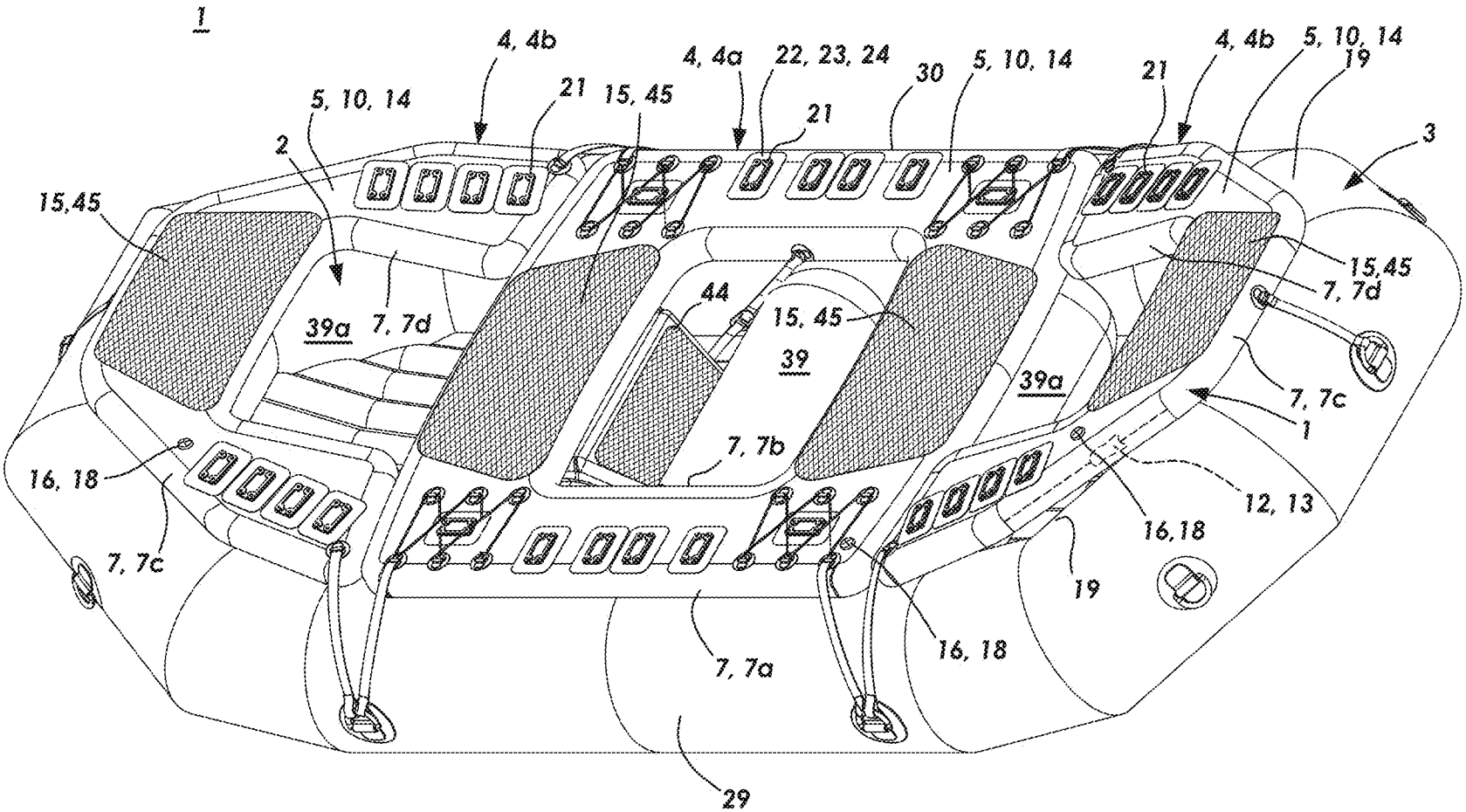
FIG. 2A is perspective view of a particular embodiment of an inflatable oar frame secured to a watercraft.
Figure 2B:
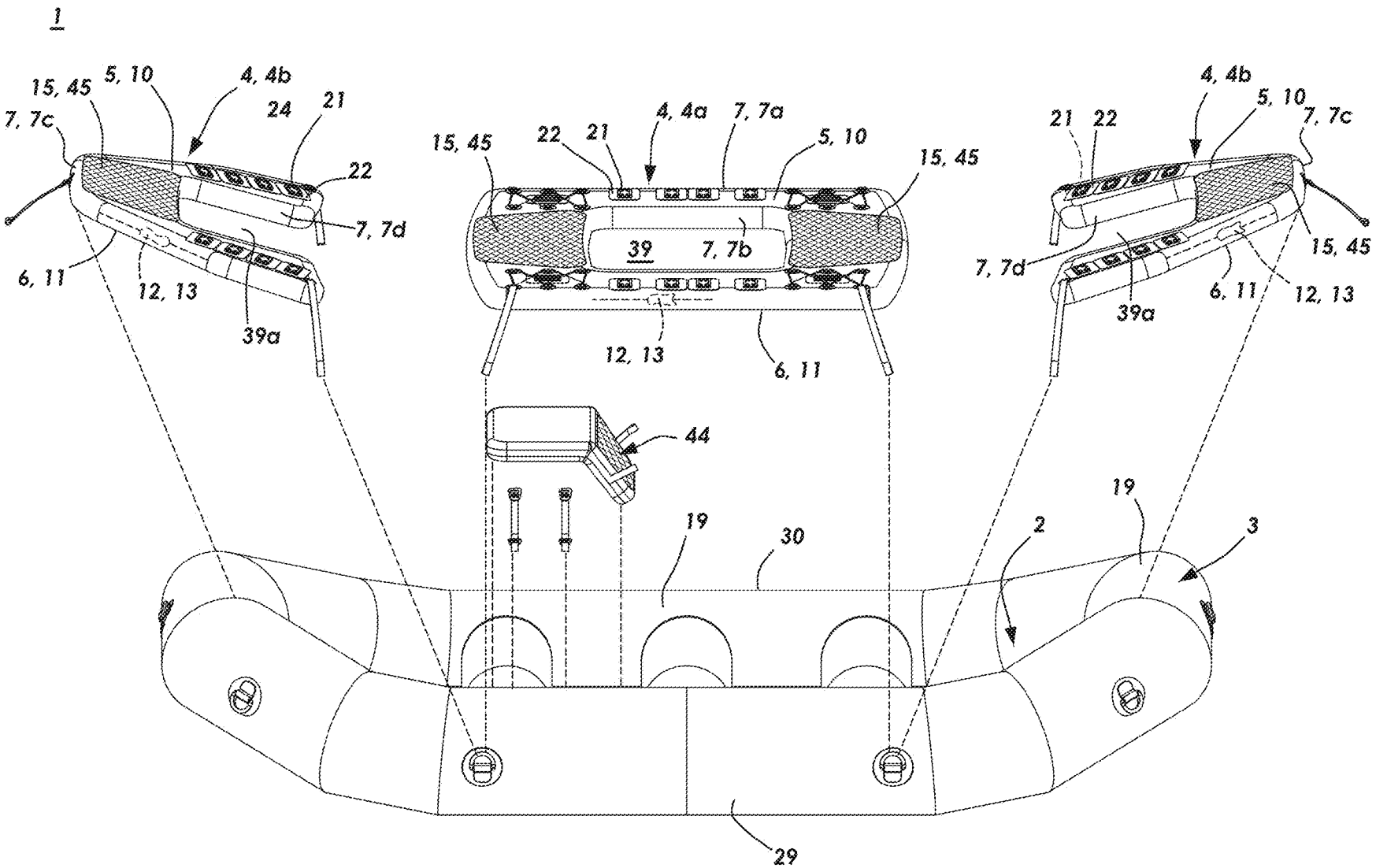
FIG. 2B is an exploded perspective view of the particular embodiment of the inflatable oar frame secured to the watercraft as depicted in FIG. 2A.
Figure 2C:
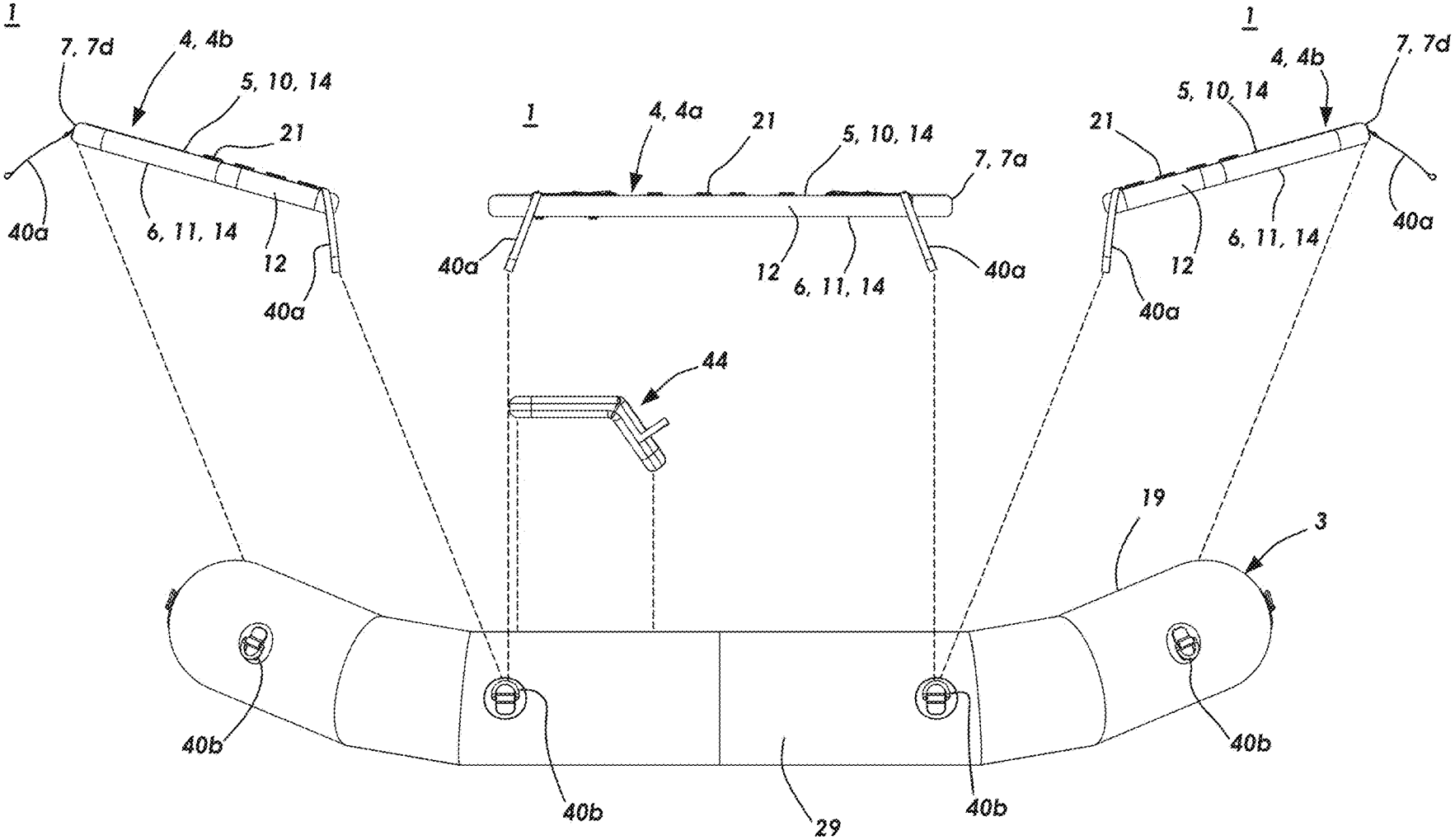
FIG. 2C is an exploded side elevation view of the particular embodiment of the inflatable oar frame secured to the watercraft as depicted in FIG. 2A.
Figure 3A:
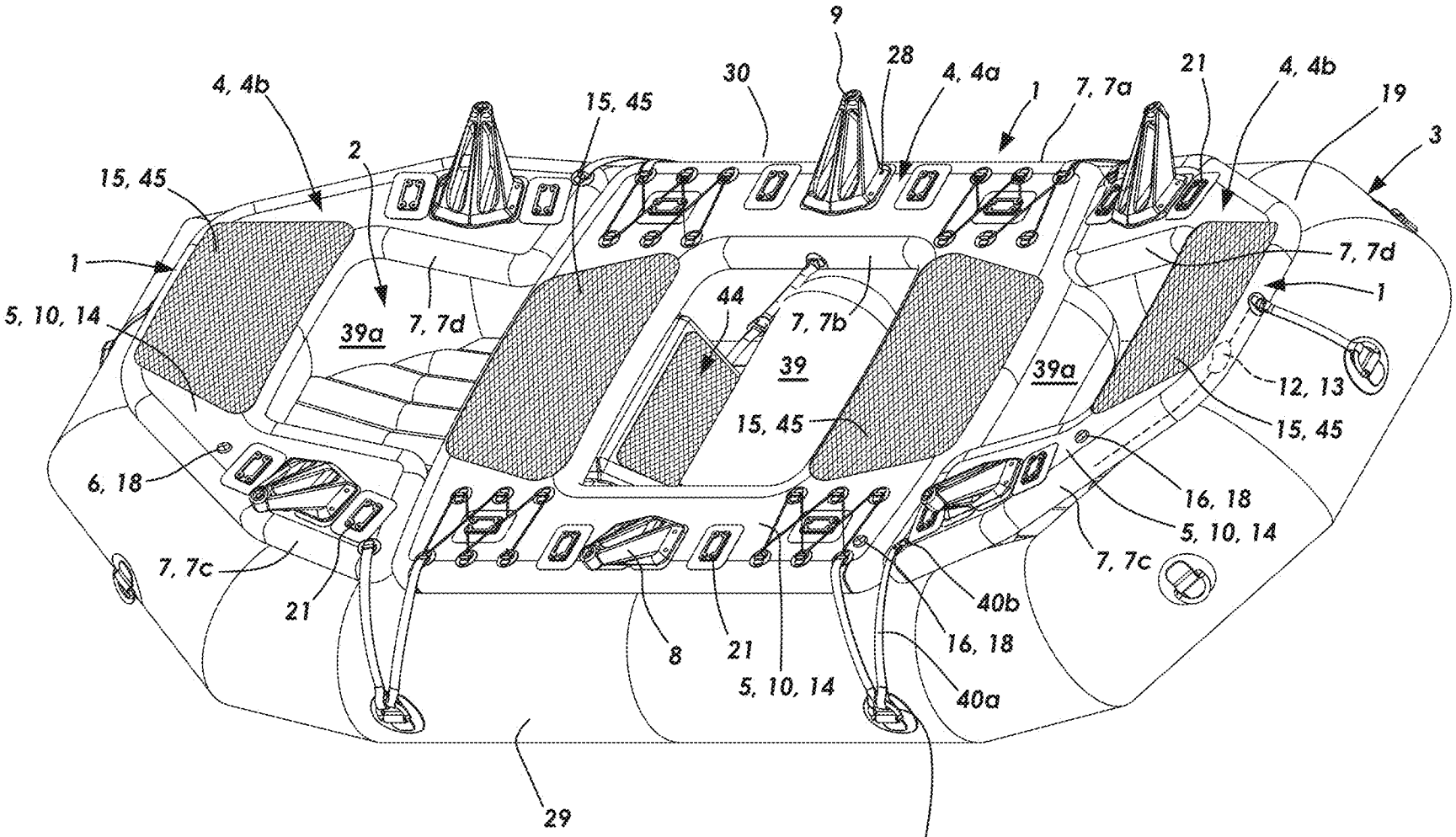
FIG. 3A is a perspective view of a particular embodiment of an inflatable oar frame secured to a watercraft, wherein a first oar tower is coupled athwart a second oar tower to the inflatable oar frame.
Figure 3B:
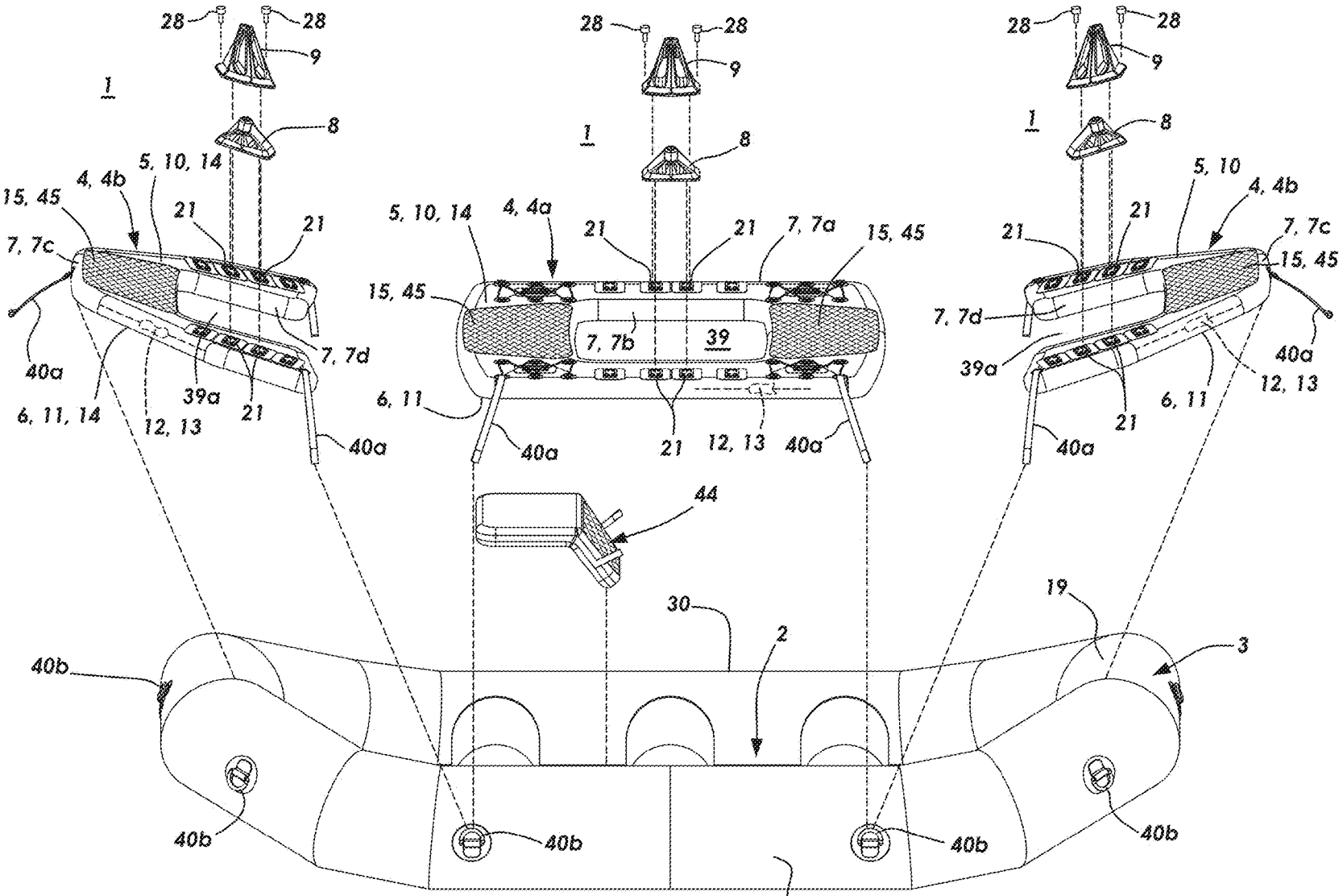
FIG. 3B is an exploded perspective view of the particular embodiment of the inflatable oar frame secured to the watercraft as depicted in FIG. 3A.
Figure 3C:
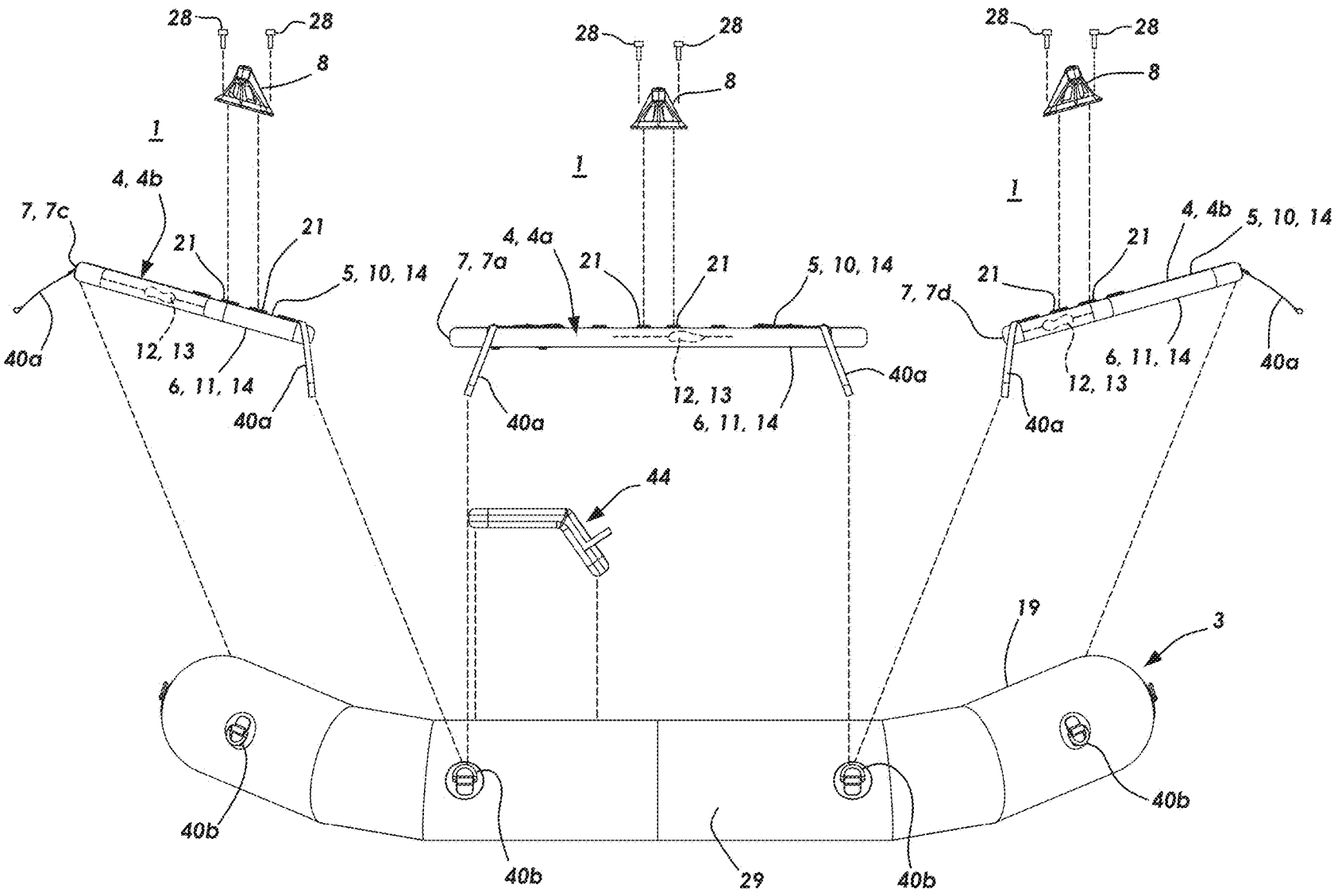
FIG. 3C is an exploded side elevation view of the particular embodiment of the inflatable oar frame secured to the watercraft as depicted in FIG. 3A.
Figure 4A:
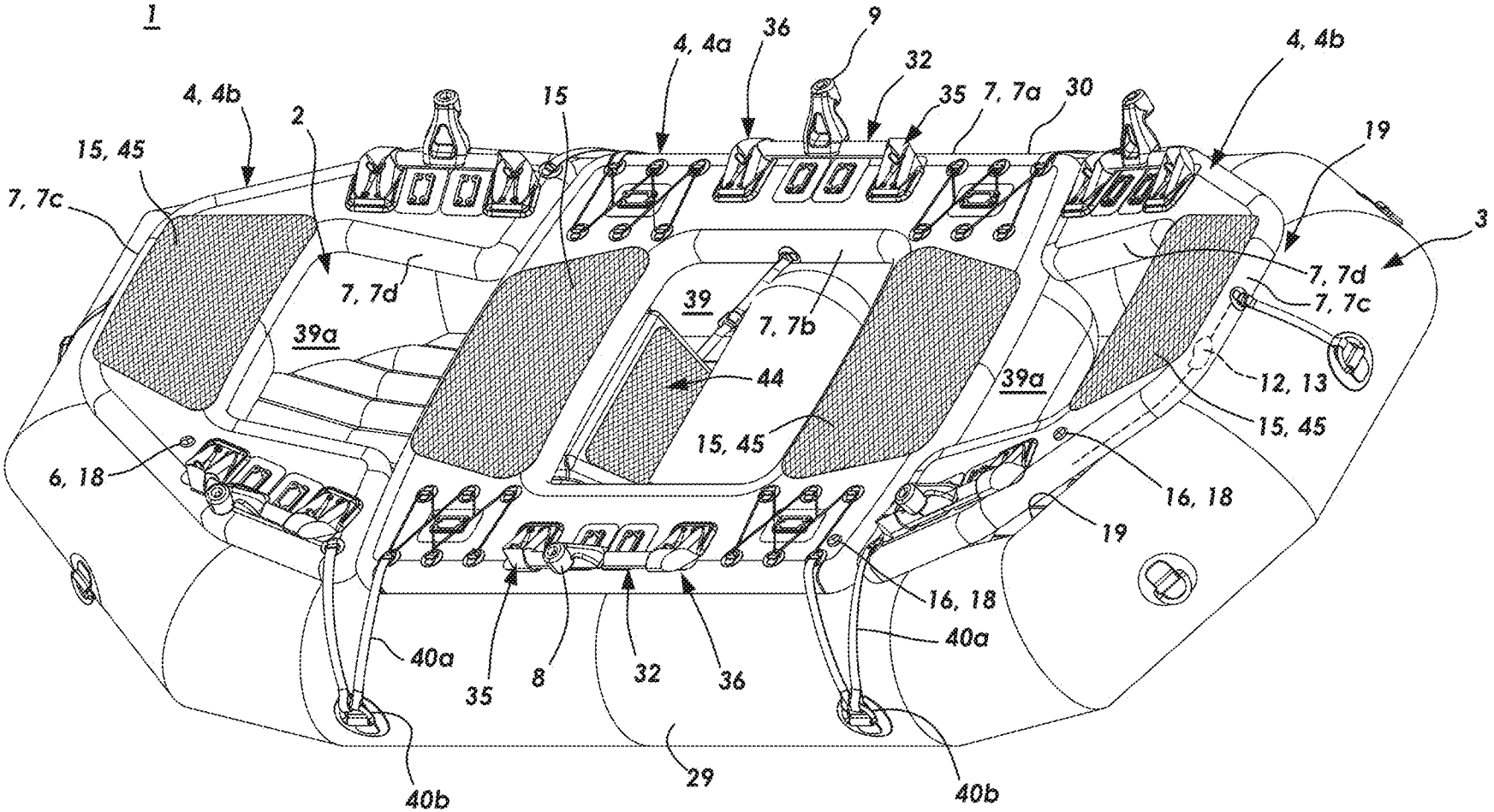
FIG. 4A is a perspective view of a particular embodiment of an inflatable oar frame secured to a watercraft, wherein a first oar tower is coupled athwart a second oar tower to the inflatable oar frame.
Figure 4B:
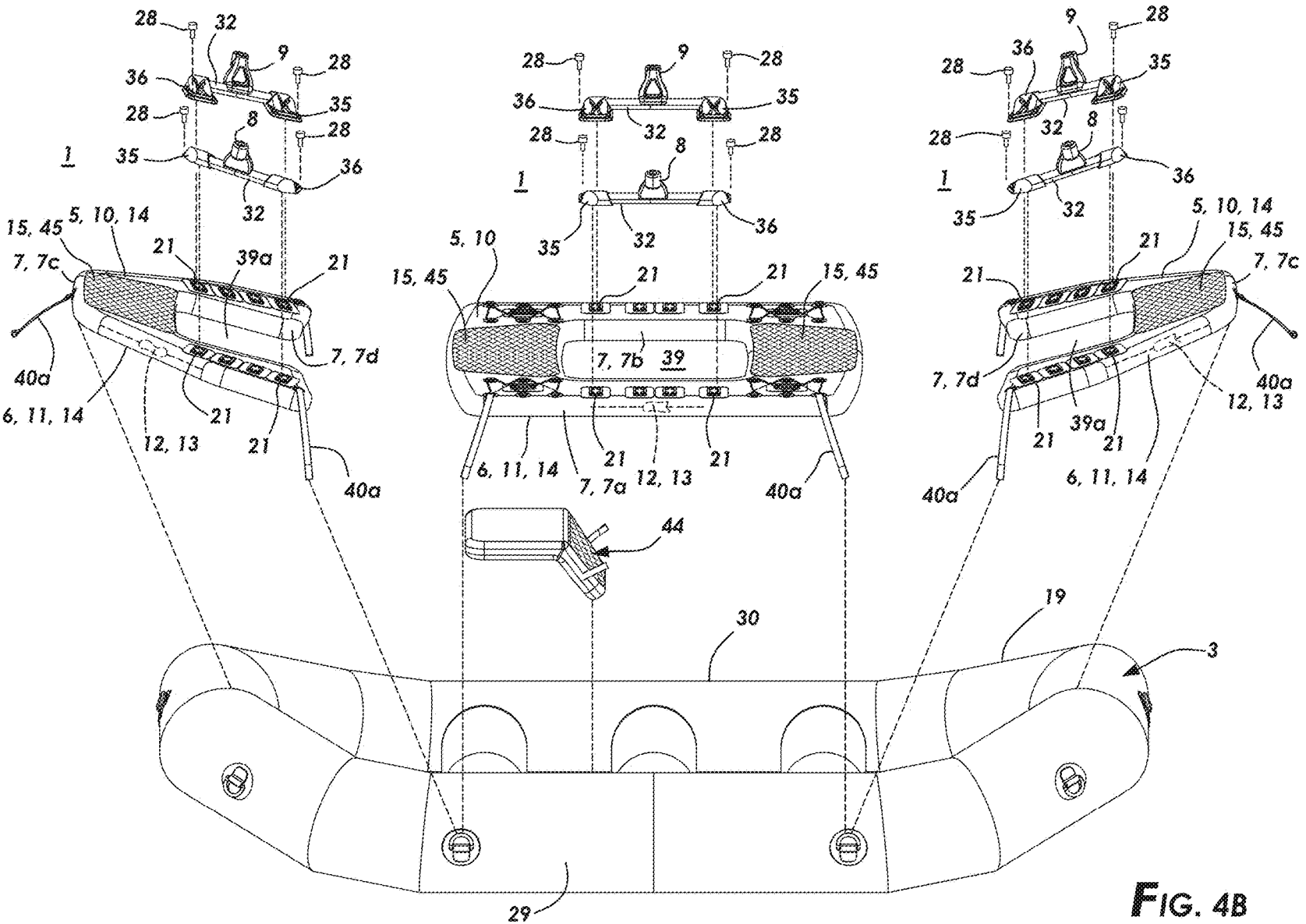
FIG. 4B is an exploded perspective view of the particular embodiment of the inflatable oar frame secured to the watercraft as depicted in FIG. 4A.
Figure 4C:
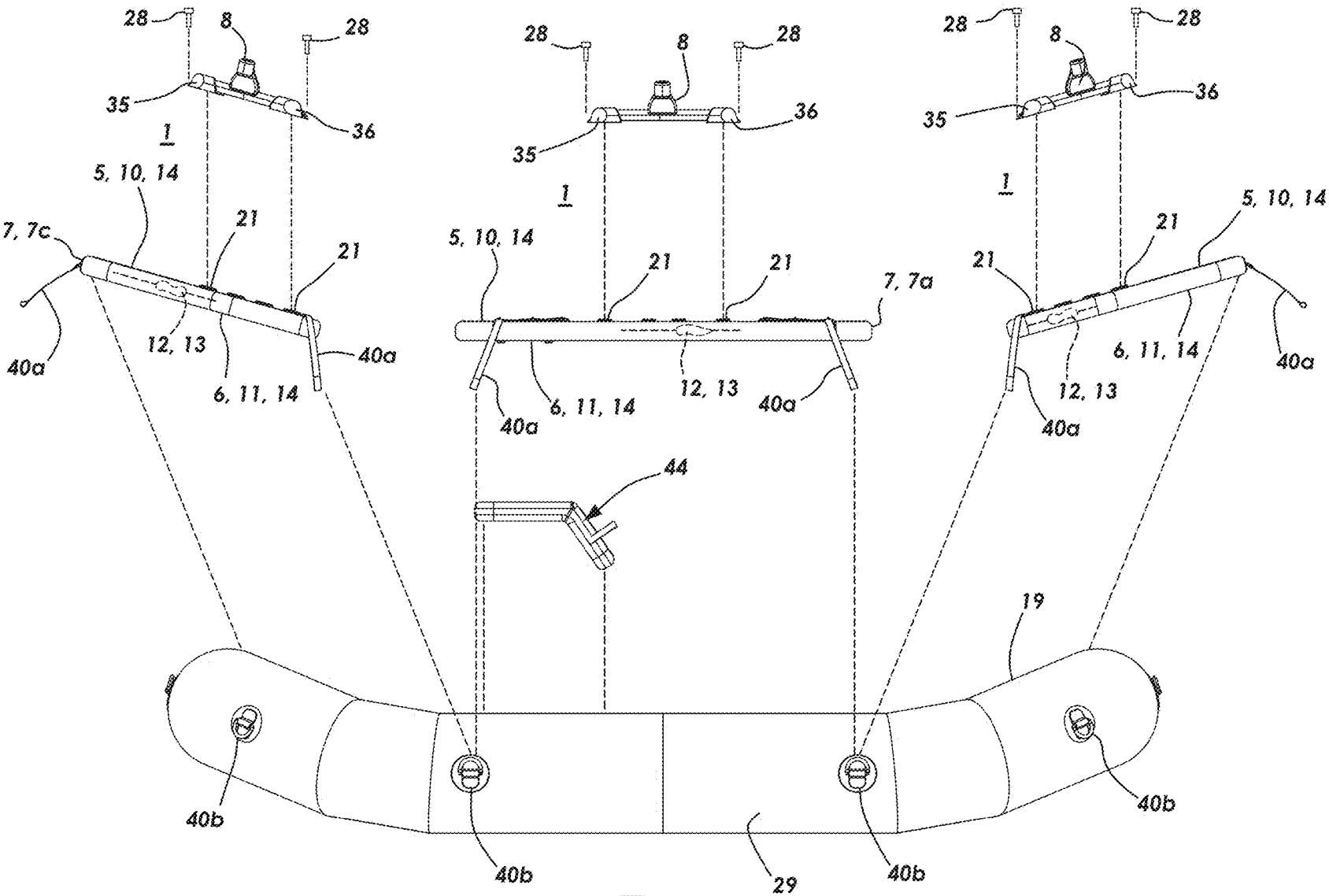
FIG. 4C is an exploded side elevation view of the particular embodiment of the inflatable oar frame secured to the watercraft as depicted in FIG. 4A.
Figure 5A:
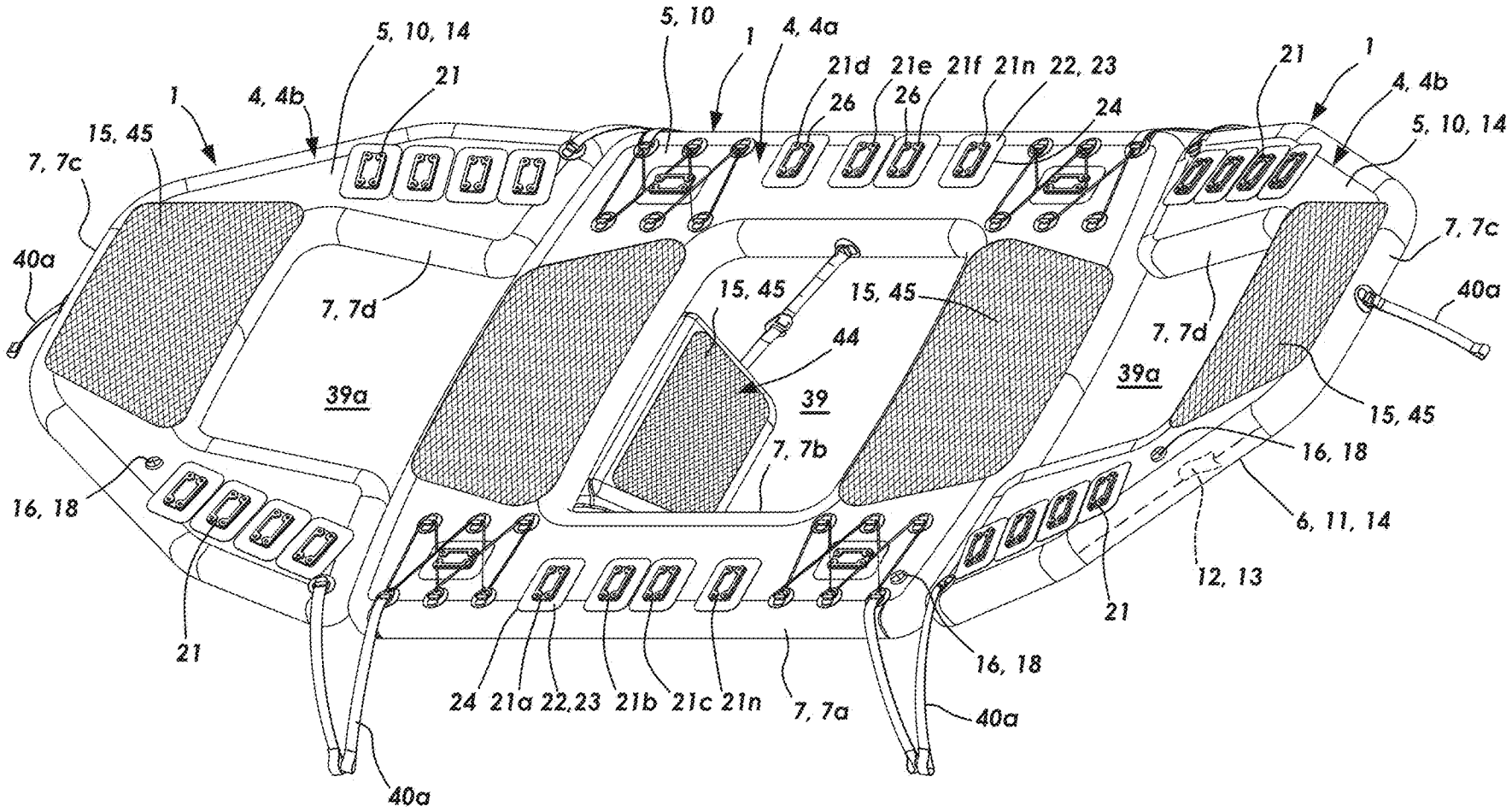
FIG. 5A is a perspective view of a particular embodiment of an inflatable oar frame including an inflatable annular oar frame body disposed between a pair of inflatable semi-annular oar frame bodies.
Figure 5B:
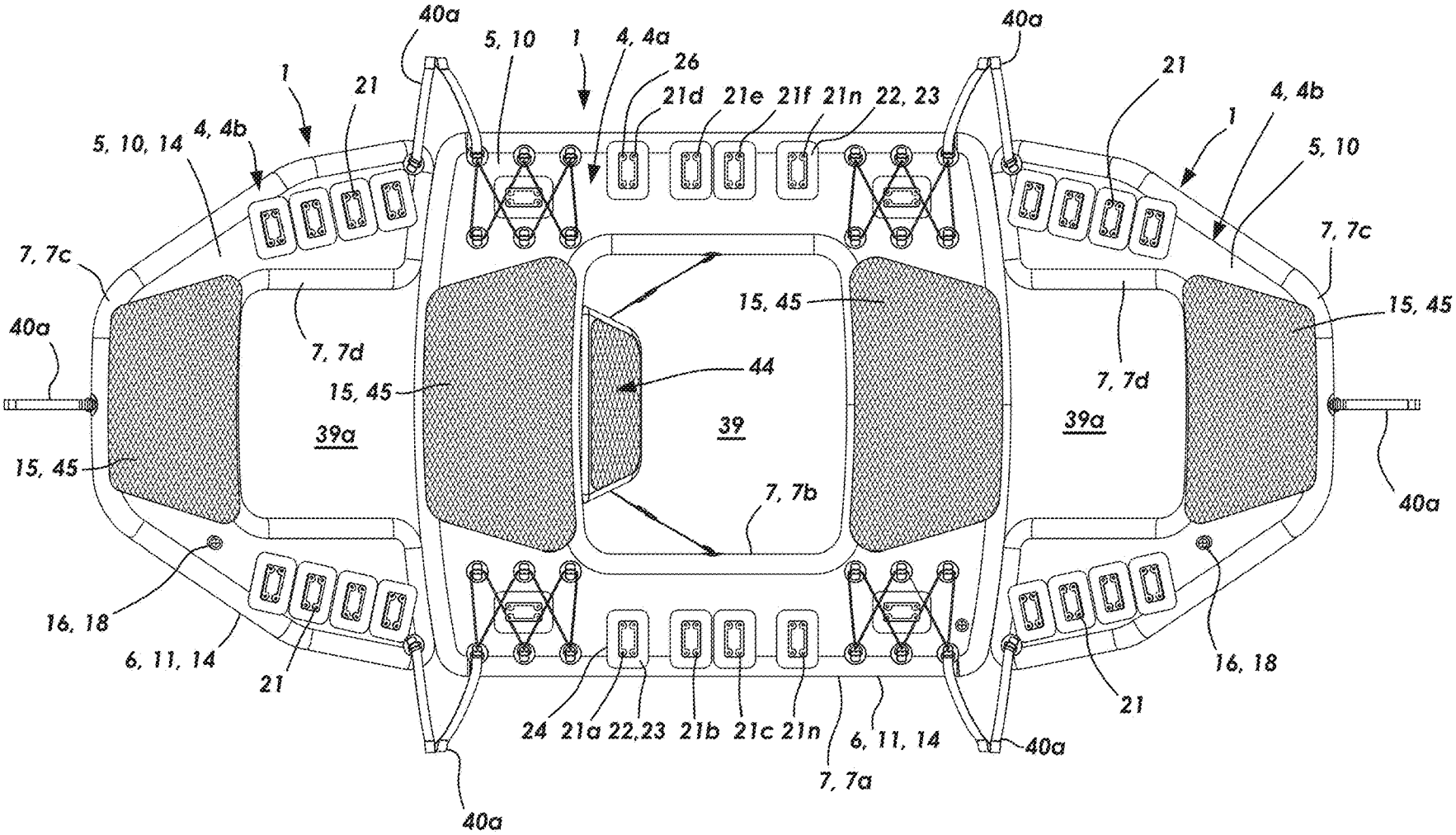
FIG. 5B is a top plan view of the particular embodiment of the inflatable oar frame including the inflatable annular oar frame body disposed between the pair of inflatable semi-annular oar frame bodies.
Figure 5C:
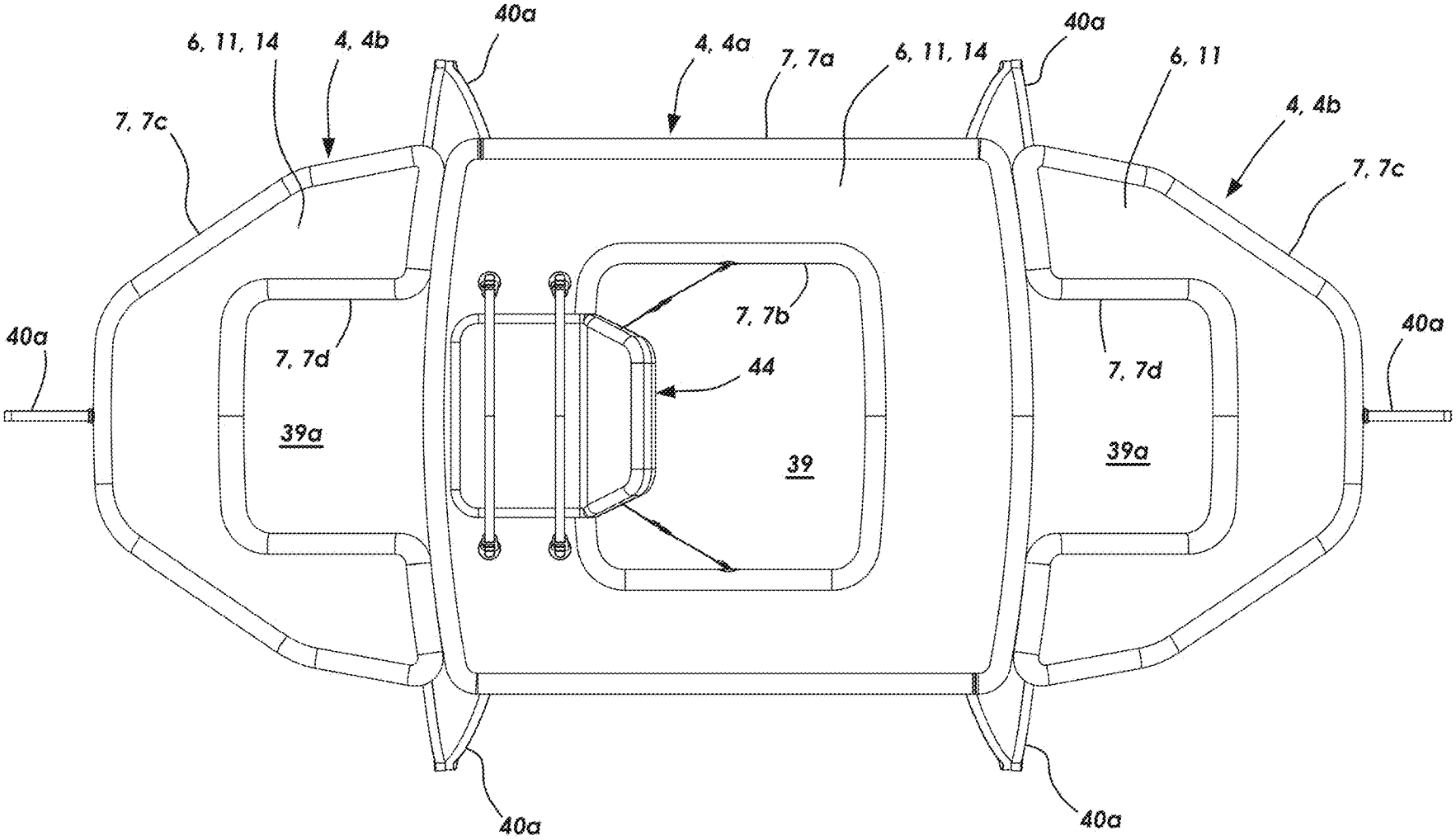
FIG. 5C is a bottom plan view of the particular embodiment of the inflatable oar frame including the inflatable annular oar frame body disposed between the pair of inflatable semi-annular oar frame bodies.
Figure 5D:
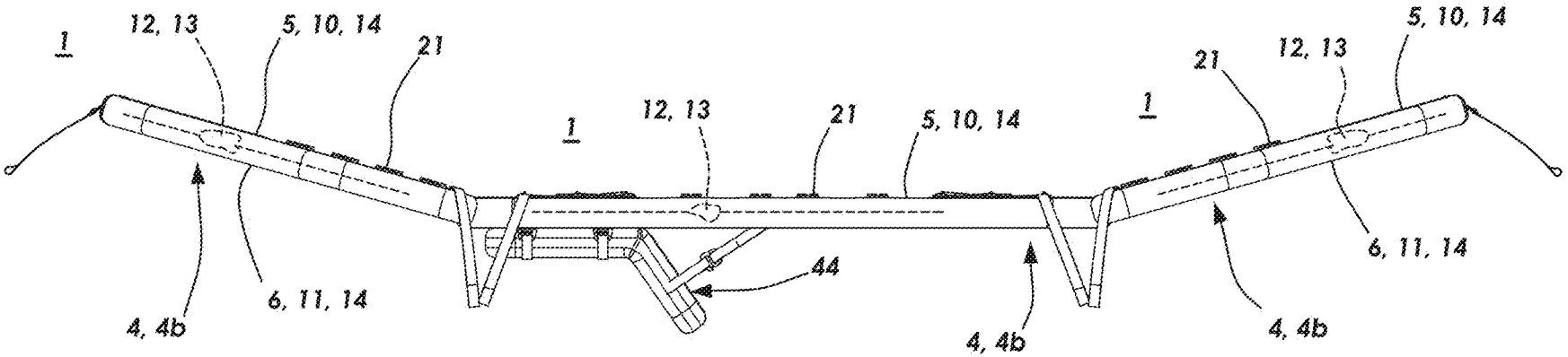
FIG. 5D is a first side elevation view of the particular embodiment of the inflatable oar frame including the inflatable annular oar frame body disposed between the pair of inflatable semi-annular oar frame bodies.
Figure 5E:
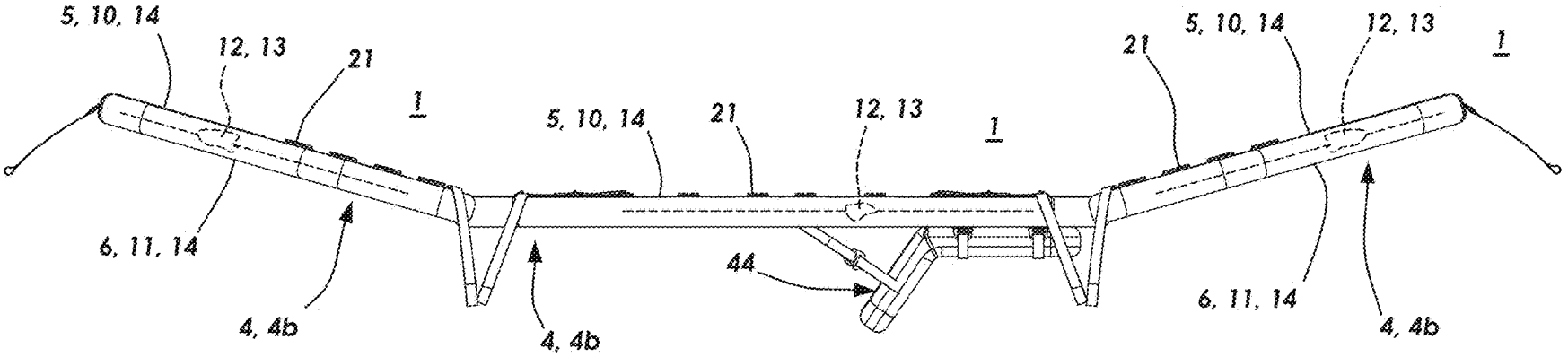
FIG. 5E is a second side elevation view of the particular embodiment of the inflatable oar frame including the inflatable annular oar frame body disposed between the pair of inflatable semi-annular oar frame bodies.
Figure 5F:
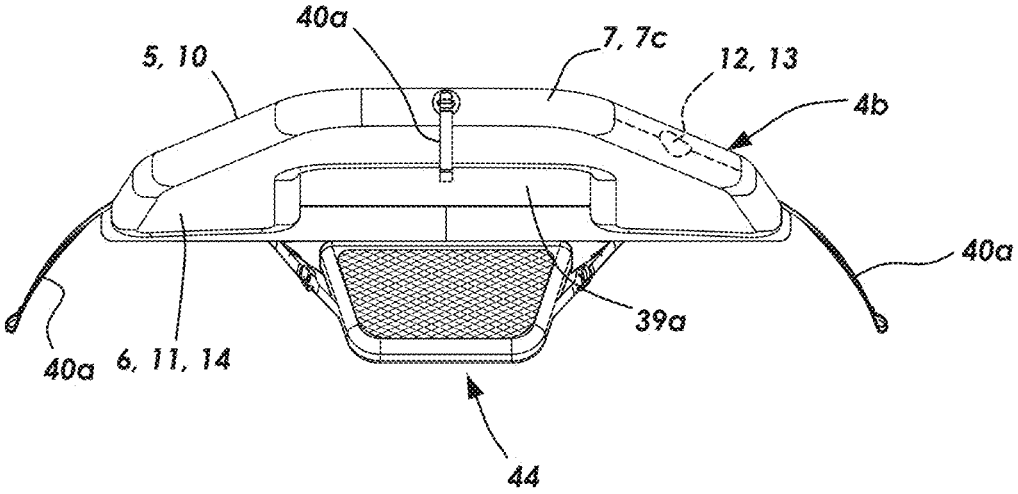
FIG. 5F is a first end elevation view of the particular embodiment of the inflatable oar frame including the inflatable annular oar frame body disposed between the pair of inflatable semi-annular oar frame bodies.
Figure 5G:
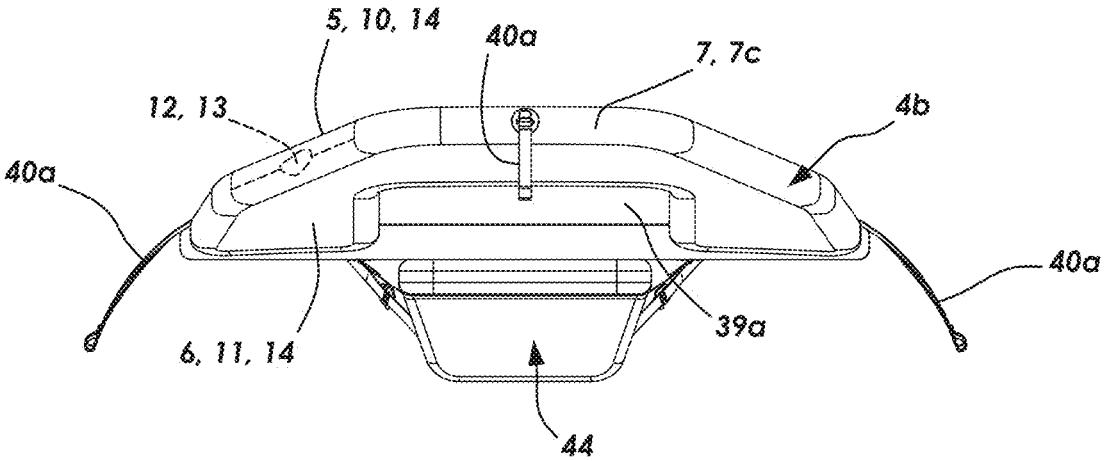
FIG. 5G is a second end elevation view of the particular embodiment of the inflatable oar frame including the inflatable annular oar frame body disposed between the pair of inflatable semi-annular oar frame bodies.
Figure 6A:
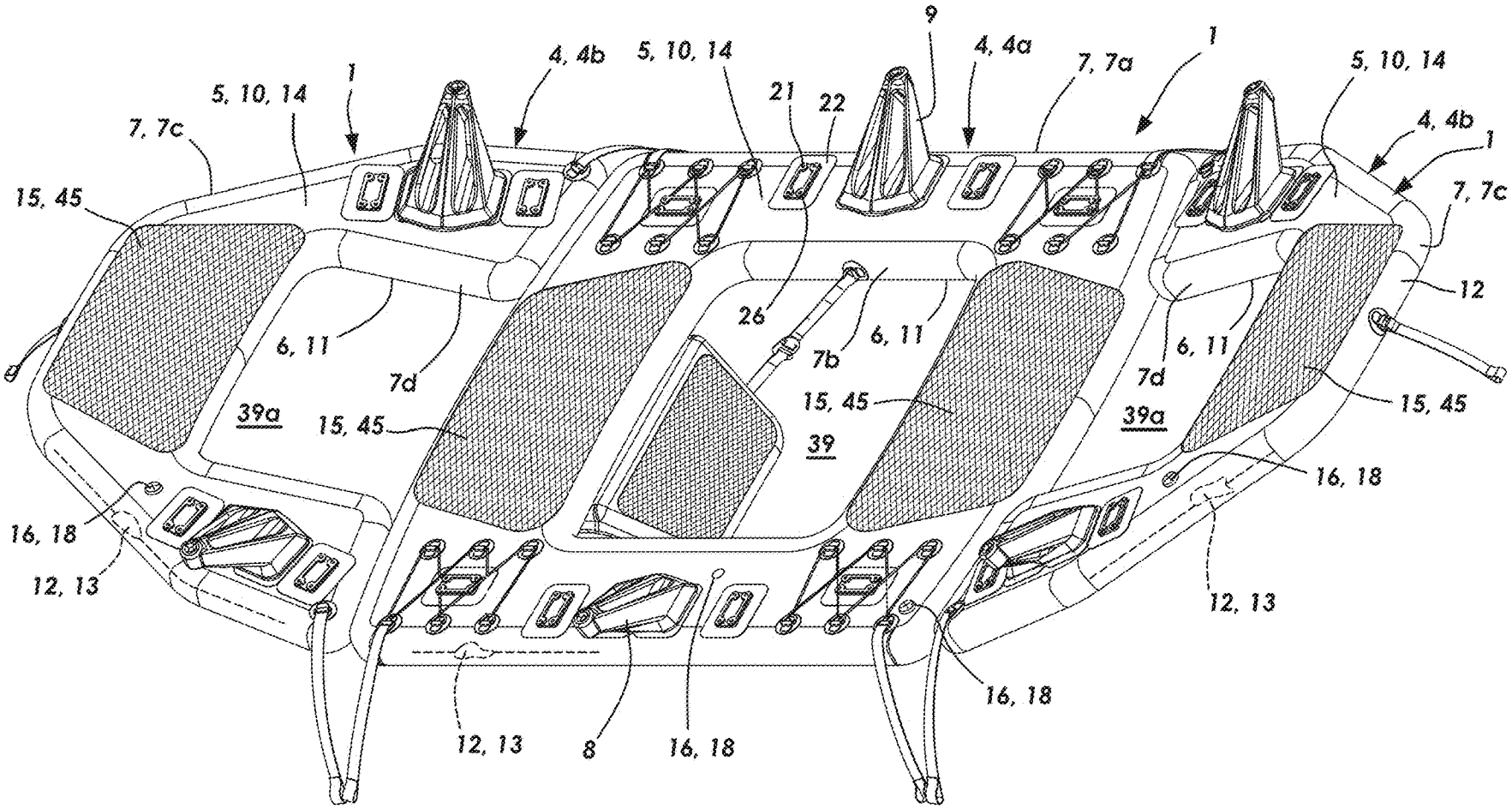
FIG. 6A is a perspective view of a particular embodiment of an inflatable oar frame including an inflatable annular oar frame body disposed between a pair of inflatable semi-annular oar frame bodies and including a particular embodiment of a first oar tower coupled to the inflatable oar frame athwart a second oar frame tower coupled to the inflatable oar frame.
Figure 6B:
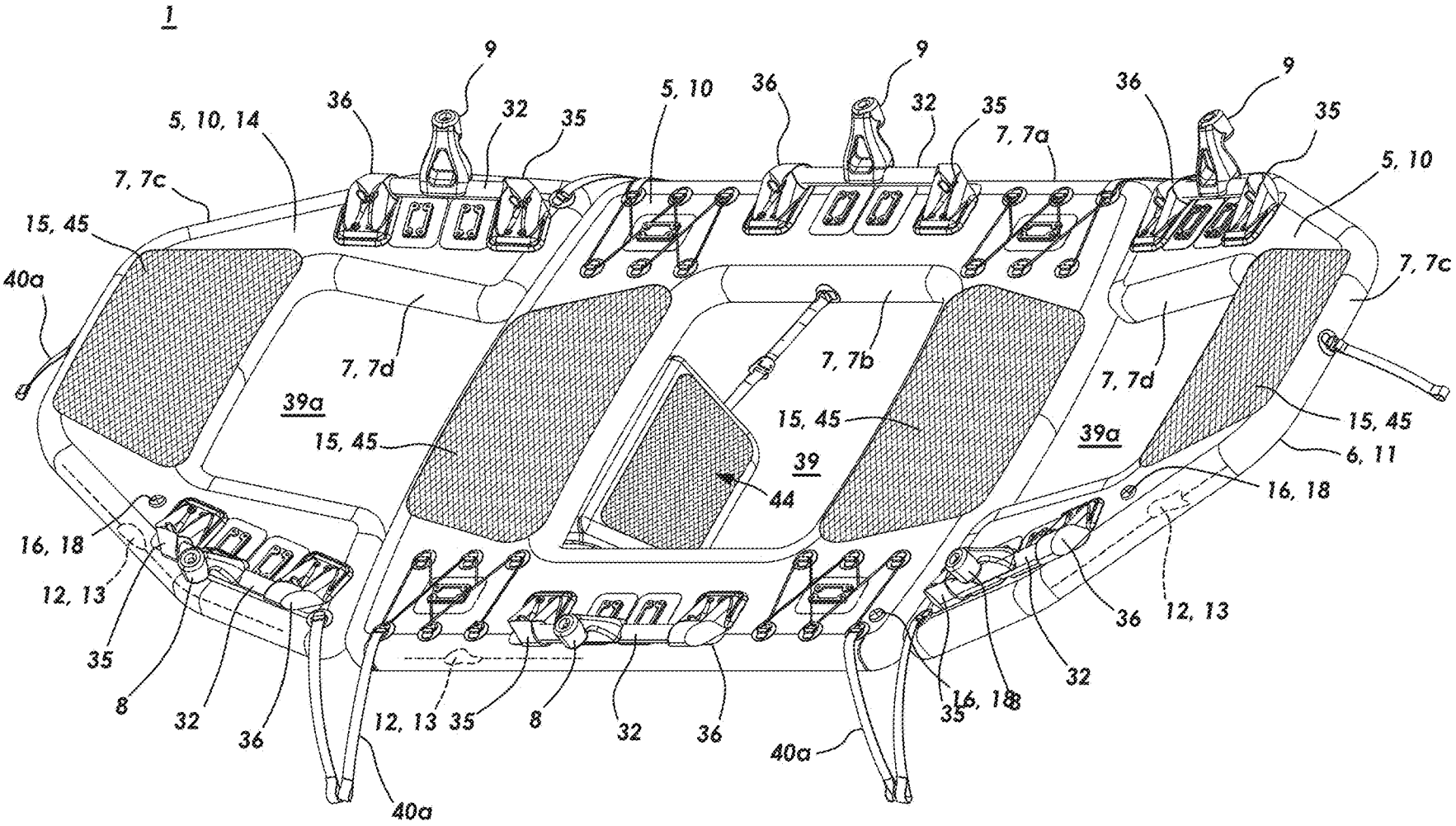
FIG. 6B is a perspective view of a particular embodiment of the inflatable oar frame including the inflatable annular oar frame body disposed between the pair of inflatable semi-annular oar frame bodies and including another particular embodiment of a first oar tower coupled to the inflatable oar frame athwart a second oar frame tower.
Figure 7A:
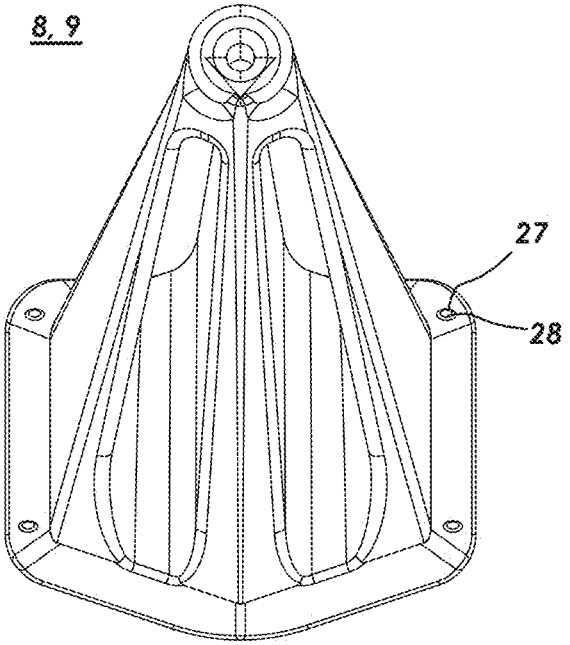
FIG. 7A is a perspective view of the particular oar tower couple to the embodiment of inflatable oar frame depicted in FIG. 6A.
Figure 7B:
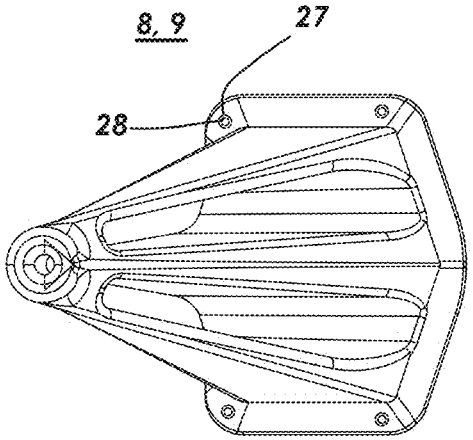
FIG. 7B is a top plan view of the particular embodiment of the oar tower depicted in FIG. 7A.
Figure 7C:
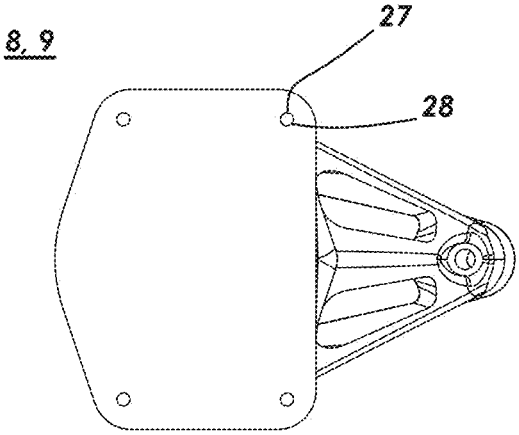
FIG. 7C is bottom plan view of the particular embodiment of the oar tower depicted in FIG. 7A.
Figure 7D:
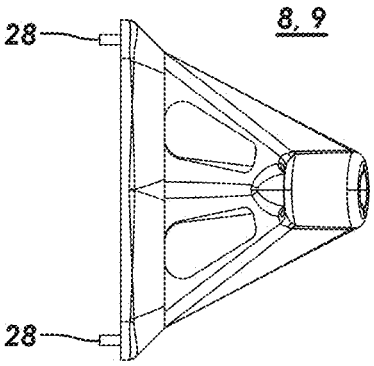
FIG. 7D is a first side elevation view of the particular embodiment of the oar tower depicted in FIG. 7A.
Figure 7E:
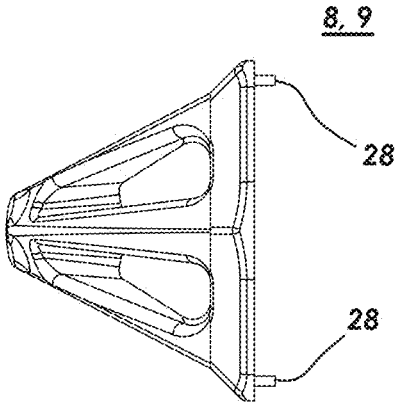
FIG. 7E is a second side elevation view of the particular embodiment of the oar tower depicted in FIG. 7A.
Figure 7F:
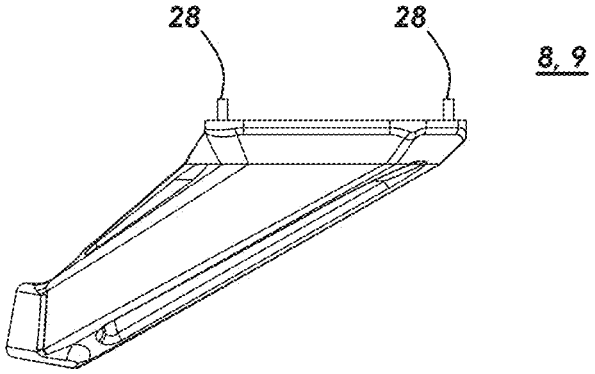
FIG. 7F is a first end elevation view is a first side elevation view of the particular embodiment of the oar tower depicted in FIG. 7A.
Figure 7G:
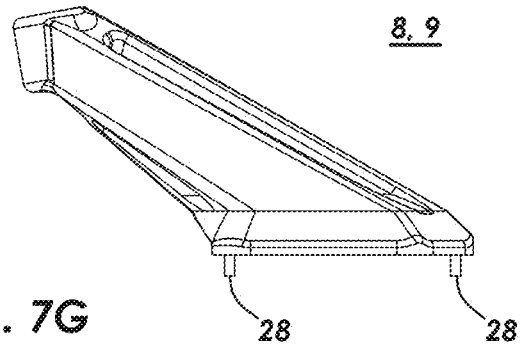
FIG. 7G is a second end elevation view is a first side elevation view of the particular embodiment of the oar tower depicted in FIG. 7A.
Figure 8A:
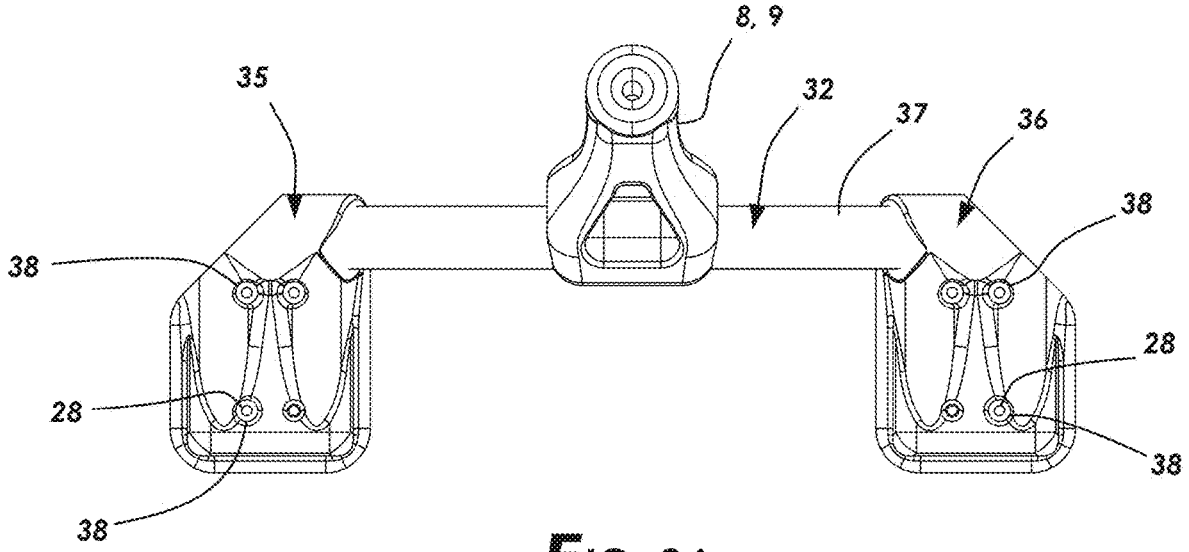
FIG. 8A is a perspective view of the particular embodiment of an oar tower coupled to the embodiment of inflatable oar frame depicted in FIG. 6B, wherein the oar tower includes an oar tower secured to a cross member having each cross member end correspondingly connected to one of a pair of cross member mounts.
Figure 8B:
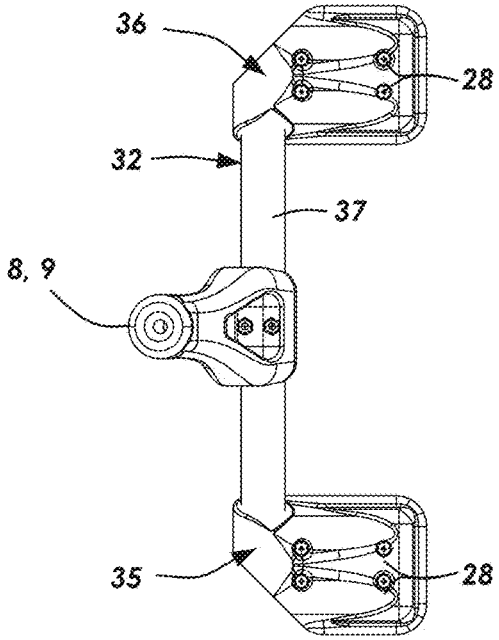
FIG. 8B is a top plan view of the particular embodiment of the oar tower depicted in FIG. 8A.
Figure 8C:
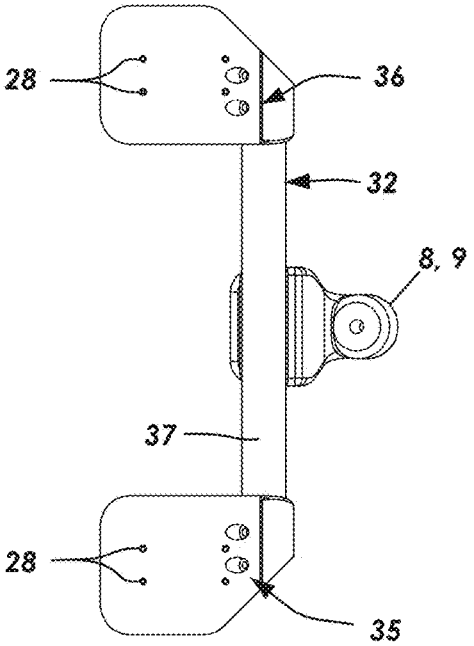
FIG. 8C is bottom plan view of the particular embodiment of the oar tower depicted in FIG. 8A.
Figure 8D:
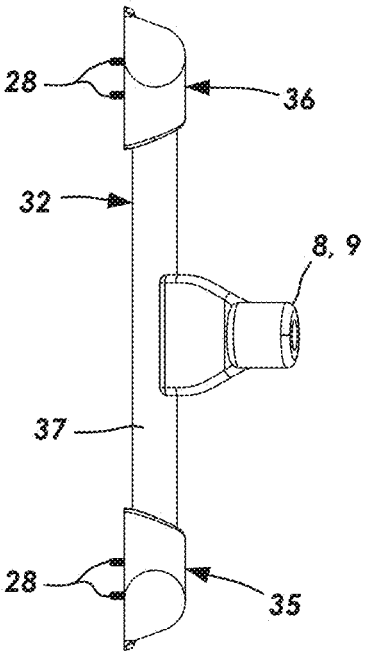
FIG. 8D is a first side elevation view of the particular embodiment of the oar tower depicted in FIG. 8A.
Figure 8E:
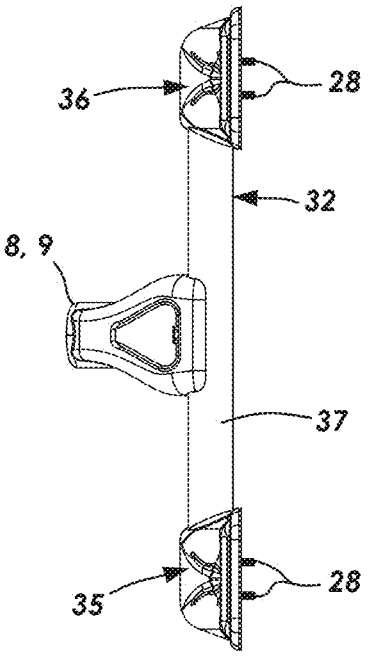
FIG. 8E is a second side elevation view of the particular embodiment of the oar tower depicted in FIG. 8A.
Figure 8F:
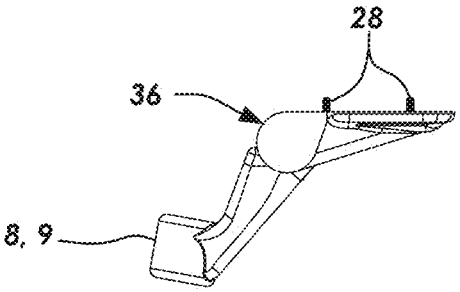
FIG. 8F is a first end elevation view is a first side elevation view of the particular embodiment of the oar tower depicted in FIG. 8A.
Figure 8G:
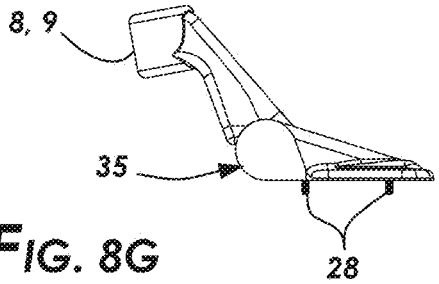
FIG. 8G is a second end elevation view is a first side elevation view of the particular embodiment of the oar tower depicted in FIG. 8A.

Now, with primary reference to FIGS. 2A and 5A, in particular embodiments, oar tower base plates (21) can be affixed to the top face (5) of the inflatable oar frame body (4). The oar tower base plates (21) can be made from a rigid material, including as examples: metal (aluminum, galvanized steel, copper, bronze) or plastic (polycarbonate, high density polyethylene, acrylonitrile butadiene styrene, polyvinyl chloride, high impact polystyrene). The oar tower base plates (21) can be adhered directly to the top face (4) of the inflatable oar frame body (4), or indirectly by affixation to a load distribution structure (22) adhered to the top face (5) of the inflatable oar frame body (4). In particular embodiments, the load distribution structure (22) can comprise a load distribution material layer (23) affixed to the top face (5) of the inflatable oar frame body (4) and extending to a load distribution material layer periphery (24) which delimits a surface area greater than the oar tower base plate (21) allowing forces applied to the oar tower base plate (21) to be spread over a greater surface area of the top face (5) of the inflatable oar frame body (4). The load distribution material layer (23) can comprise an additional layer of the top face fabric material (10) or can comprise a different material which may have a greater rigidity than the top face fabric material (10). Illustrative examples of the load distribution material layer (23) configured to overlay the top face fabric material (10) and underlay the oar tower base plate (21) include: plasticized fabric, vulcanized rubber, string reinforced plastic, polyethylene sheet, acrylic-polyvinyl chloride sheet, and combinations thereof. In particular embodiments, the oar tower base plates (21) can be disposed within oar tower base plate pockets (25) affixed to the top face (5) of the inflatable oar frame body (4).

Now, with primary reference to FIGS. 3A-3C and 6A, in particular embodiments, one or more oar towers (8, 9) can be secured directly to a corresponding one or more oar tower base plates (21) affixed to the top face (5) of the inflatable oar frame body (4). As shown in the illustrative examples, an oar tower base plate (21) can include a plurality of base plate threaded apertures (26) alignable with a corresponding plurality of oar tower apertures (27) of an oar tower (8, 9). A plurality of threaded fasteners (28) can be disposed in each the plurality of oar tower apertures (27) of the oar tower (8, 9) and rotatingly engaged with the plurality of base plate threaded apertures (26) in the oar tower base plate (21) to secure the oar tower (8, 9) to the oar tower base plate (21). As shown in the examples, a first plurality of oar tower base plates (21*a*, 21*b*, 21*c* . . . 21$_n$) can be affixed proximate the port side (29) of the inflatable oar frame body (4) athwart a second plurality of oar tower base plates (21*d*, 21*e*, 21*f* . . . 21$_n$) affixed proximate the starboard side (30) of the inflatable oar frame body (4). One of a pair of oar towers (8, 9) can be secured to one or more of the first plurality of oar tower base plates (21*a*, 21*b*, 21*c* . . . 21$_n$) on the port side (29) of the inflatable oar frame body (4) and one of the pair of oar towers (8,9) can be secured to one or more of the second plurality of oar tower base plates (21*d*, 21*e*, 21*f* . . . 21$_n$) on the starboard side (30) of the inflatable oar frame body (4) to positionally accommodate the unique structural makeup of a body of a rower (31).

Now, with primary reference to FIGS. 4A through 4C and 6B, in particular embodiments, an oar tower (8, 9) can be secured to a cross-member (32) having each of cross-member ends (33, 34) correspondingly connected to one of a pair of cross-member mounts (35, 36). As shown in the examples, the cross-member (32) can be configured to afford a cylindrical surface (37) between the cross member ends (33, 34). The cross-member outer diameter can be about one and one quarter inches (about 31.75 millimeters) to about one and five eights inches (about 41.28 millimeters) to allow a wide variety of conventional oar towers to be secured to the cross-member (32) without modification. However, this illustrative example is not intended to limit the cross-member (32) to any particular cross-sectional geometry or dimensions, and the cross-member (32) can be adapted or configured to matingly engage with any corresponding geometry or dimensions of an oar tower (8, 9). The pair of cross-member mounts (35, 36) can each include a plurality of cross-member mount apertures (38) alignable with a corresponding plurality of base plate threaded apertures (26) disposed in a pair of the oar tower base plates (21) affixed to the top face (5) of the inflatable oar frame body (4). A plurality of threaded fasteners (28) can be disposed in each the plurality of cross member mount apertures (38) of the pair of cross member mounts (35, 36) and rotatingly engaged with the plurality of base plate threaded apertures (26) of the corresponding pair of oar tower base plates (21) to secure the pair of cross-member mounts (35, 36) to the corresponding pair of the oar tower base plates (21). The pair of cross-member mounts (35, 36) can be positionally secured along the cross member (32) to align the plurality of cross-member mount apertures (38) with the corresponding plurality of threaded apertures (27) disposed in a pair of the oar tower base plates (21). Similarly, the oar towers (8,9) can be positionally secured along the cross member (32) to accommodate the unique structural makeup of a body of rower (31). A first oar (41) and a second oar (42) can correspondingly be coupled to a first oar tower (8) and a second oar tower (9).

Now, with primary reference to FIGS. 5A through 5G, particular embodiments of the inflatable oar frame body (4) can be configured as an inflatable annular oar frame body (4*a*) having the top face (10) and the bottom face (11) extending between an outer annular oar frame body periphery (7*a*) and an inner annular periphery (7*b*). The inner annular periphery (7*b*) can define a passthrough (39) open between the top face (10) and the bottom face (11) of the inflatable annular oar frame body (4*a*). In particular embodiments, the passthrough (39) can be disposed between a first plurality of oar tower base plates (21*a*, 21*b*, 21*c* . . . 21$_n$) of the inflatable annular oar frame body (4*a*) proximate the port side (29) athwart a second plurality of oar tower base plates (21*d*, 21*c*, 21*f* . . . 21$_n$) affixed to the top face (5) of the inflatable annular oar frame body (4*a*) proximate the starboard side (30). A first oar tower (8) can be secured directly or indirectly to the first plurality of oar tower base plates (21*a*, 21*b*, 21*c* . . . 21$_n$) and a second oar tower (9) can be secured to the second plurality of oar tower base plates (21*d*, 21*e*, 21*f* . . . 21$_n$). The inflatable annular oar frame body (4*a*) can be inflated and disposed over the watercraft interior (2) and/or supported by the gunwale (19) of the watercraft (3). A plurality of oar frame anchors (40) can be used to secure the inflated annular oar frame body (4) to the watercraft (3). As depicted in the Figures, an illustrative example of a plurality of oar frame anchors (40) can comprise a plurality of anchor straps (40*a*) each adjustably fastened between anchor strap fasteners (40*b*) affixed to the oar frame body (4) and to the watercraft (3). In particular embodiments, the inflatable annular ore frame body (4) can be the only frame used in association with the watercraft (3) and no other frame is required.

Now, with primary reference to FIG. 1, a particular method of using the inflatable annular oar frame body (4*a*), a rower (31) can sit on the top face (5) of the inflatable annular oar frame body (4*a*) adjacent the passthrough (39) and between a first oar tower (8) and the second oar tower (9) with the rower's legs (31*a*) extending through the passthrough (39) into the watercraft interior (2) of the watercraft (3). The rower (31) can grasp the first oar (41) coupled to the first oar tower (8) and grasp the second oar (42) coupled to the second oar tower (9). The first and second oar (41, 42) can be pulled to move the watercraft (3) through the water (43).

Now, with primary reference to FIGS. 5A through 5G, particular embodiments of the inflatable oar frame body (4) can be configured as an inflatable semi-annular oar frame body (4*b*) having the top face (5) and the bottom face (6) extending between an outer semi-annular periphery (7*c*) and an inner semi-annular periphery (7*d*). The inner semi-annular periphery (7*d*) can define a semi-annular passthrough (39*a*) open between the top face (5) and the bottom face (6) of the inflatable annular oar frame body (4*b*). In particular embodiments, the semi-annular passthrough (39*a*) can be disposed between a first plurality of oar tower base plates (21*a*, 21*b*, 21*c* . . . 21$_n$) affixed to the top face (5) of the inflatable semi-annular oar frame body (4) proximate the port side (29) athwart a second plurality of oar tower base plates (21*d*, 21*e*, 21*f* . . . 21$_n$) affixed to the top face (5) of the semi-annular oar frame body (4*b*) proximate the starboard side (30). A first oar tower (8) can be secured directly or indirectly to one or more of the first plurality of oar tower base plates (21*a*, 21*b*, 21*c* . . . 21$_n$) and a second oar tower (9) can be secured to one or more of the second plurality of oar tower base plates (21*d*, 21*c*, 21*f* . . . 21$_n$). The inflatable semi-annular oar frame body (4*b*) can be inflated and disposed over the watercraft interior (2) and/or supported by the gunwale (19) of the watercraft (3). A plurality of inflatable oar frame anchors (40) can be used to secure the inflated semi-annular oar frame body (4*b*) to the watercraft (3). As depicted in the Figures, an illustrative example of a plurality of inflatable oar frame anchors (40) can comprise a plurality of anchor straps (40*a*) each length adjustable between anchor strap fasteners (40*b*) affixed to the semi-annular oar frame body (4*b*) and the watercraft (3). In particular embodiments, the inflatable semi-annular ore frame body (4*b*) can be the only frame used in association with the watercraft (3) and no other frame is required.

Again, in similar fashion to the method depicted in FIG. 1, a particular method of using the inflatable semi-annular oar frame body (4*b*), a rower (31) can sit on the top face (5) of the inflatable semi-annular oar frame body (4*b*) adjacent the semi-annular passthrough (39*b*) and between the first oar tower (8) and the second oar tower (9) with the rower's legs (31*a*) extending through the semi-annular passthrough (39*a*) into the watercraft interior (2) of the watercraft (3). The rower (31) can grasp the first oar (41) coupled to the first oar tower (8) and grasp the second oar (9) coupled to the second oar tower (9). The first and second oar (41, 42) can be pulled to move the watercraft (3) through the water (43).

Again, with primary reference to FIGS. 5A through 5G, in particular embodiments, one inflatable annular oar frame body (4*a*) or one inflatable semi-annular oar frame body (4*b*) can be secured to a watercraft (3) and used alone without any other frame. Alternatively, a plurality of inflatable annular oar frame bodies (4*a*) can be secured to a watercraft (3) or a plurality of inflatable semi-annular oar frame bodies (4*b*) can be secured to a watercraft (3). As shown in the illustrative example, an inflatable annular oar frame body (4*a*) can be disposed adjacent an inflatable semi-annular oar frame body (4*b*) or be disposed between a pair of inflatable semi-annular oar frame bodies (4*b*). Understandably, depending on the configuration of the watercraft (3), embodiments of the inflatable oar frame body (4, 4*a*, 4*b*) can be secured to the watercraft (3) in various structural permutations and combinations to afford an inflatable oar frame(s) (4, 4*a*, 4*b*) to which ore frame towers (8, 9) can be coupled for the purpose of coupling oars (41, 42) which can be used for rowing to move the watercraft (3) through the water (43).

Again, with primary reference to FIGS. 5A through 5G, in particular embodiments, an inflatable or non-inflatable foot plate (44) can be disposed to engage a rower's feet (31*b*) of a rower (31) positioned on the top face (5) of the inflatable oar frame body (4, 4*a*, 4*b*). As an example, the foot plate (44) can be coupled to the bottom face (6) of the inflatable annular oar frame body (4, 4*a*, 4*b*) opposite the seat portion (45) of the top face (6). In particular embodiments, the seat portion (45) can comprise an inflatable or non-inflatable seat coupled to the top face (5) of the inflatable oar frame (1).

As can be easily understood from the foregoing, the basic concepts of the present invention may be embodied in a variety of ways. The invention involves numerous and varied embodiments of an inflatable oar frame and methods for making and using such inflatable oar frame.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "mount" should be understood to encompass disclosure of the act of "mounting"—whether explicitly discussed or not—and, conversely, were there effectively disclosure of the act of "mounting", such a disclosure should be understood to encompass disclosure of a "mount" and even a "means for mounting". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the inflatable oar frame herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. An inflatable oar frame, comprising:

an inflatable oar frame body adapted to mount over a watercraft interior, said inflatable oar frame body having a top face opposite a bottom face extending to an inflatable oar frame body periphery;

a first oar tower base plate coupled to said top face of said inflatable oar frame body substantially athwart a second oar tower base plate coupled to said top face of said inflatable oar frame body, wherein said first oar tower base plate and said second oar tower base plate are adapted to correspondingly couple to a first oar tower and a second oar tower.

2. The inflatable oar frame of claim 1, further comprising a first oar tower coupled to said first oar tower base plate coupled to said top face of said inflatable oar frame body and a second oar tower coupled to said second oar tower base plate coupled to said top face of said inflatable oar frame body.

3. The inflatable oar frame of claim 2, further comprising a first oar coupled to said first oar tower and a second oar coupled to said second oar tower.

4. The inflatable oar frame of claim 1, wherein a first oar tower base plate comprises a first plurality of oar tower base plates and wherein said second oar tower base plate comprises a second plurality of oar tower base plates.

5. The inflatable oar frame of claim 4, further comprising a first oar tower configured to couple to one or more of said first plurality of oar tower base plates and a second oar tower configured to fasten to one or more of said second plurality of oar tower base plates.

6. The inflatable oar frame of claim 5, further comprising a first oar tower coupled to one or more of said first plurality of oar tower base plates and a second oar tower coupled to one or more of said second plurality of oar tower base plates.

7. The inflatable oar frame of claim 6, further comprising a first oar coupled to said first oar tower and a second oar coupled to said second oar tower.

8. An inflatable oar frame, comprising:

an inflatable oar frame body adapted to mount over a watercraft interior, said inflatable oar frame body having a top face opposite a bottom face extending to an inflatable oar frame body periphery; and a passthrough disposed between said top face and said bottom face of said inflatable oar frame body, wherein said inflatable oar frame body is adapted to couple to a first oar tower substantially athwart a second oar tower.

9. The inflatable oar frame of claim 8, wherein said inflatable oar frame body comprises an inflatable annular oar frame body having said top face and said bottom face extending between an outer annular periphery and an inner annular periphery, said inner annular periphery defining said passthrough open between said top face and said bottom face.

10. The inflatable oar frame of claim 8, wherein said inflatable oar frame body comprises an inflatable semi-annular oar frame body having said top face and said bottom face extending between an outer semi-annular periphery and an inner semi-annular periphery, said inner semi-annular periphery defining said passthrough open between said bottom face and said top face.

11. The inflatable oar frame of claim 8, wherein said inflatable oar frame body comprises an inflatable annular oar frame body having said top face and said bottom face extending between an outer annular periphery and an inner annular periphery, said inner annular periphery defining said passthrough open between said top face and said bottom face disposed adjacent an inflatable semi-annular oar frame body having said top face and said bottom face extending between an outer semi-annular periphery and an inner semi-annular periphery, said inner semi-annular periphery defining said passthrough open between said bottom face and said top face.

12. The inflatable oar frame of claim 11, wherein said inflatable oar frame body comprises an inflatable annular oar frame body disposed between a pair of inflatable semi-annular oar frame bodies.

13. The inflatable oar frame of claim 8, wherein said top face of said inflatable oar frame body having a seat portion disposed adjacent said passthrough and medially between said first plurality of oar tower base plates and said second plurality of oar tower base plates, wherein said passthrough configured to allow a rower's legs to pass into the watercraft interior of said watercraft while positioned on said seat portion.

14. The inflatable oar frame of claim 13, further comprising a foot plate disposed opposite said seat portion, said foot plate configured to engage a rower's feet while positioned on said seat portion.

15. The inflatable oar frame of claim 1, further comprising a plurality of inflatable oar frame anchors affixed to said inflatable oar frame body, said a plurality of inflatable oar frame anchors adapted to secure said inflatable oar frame body to said watercraft over said watercraft interior.

16. The inflatable oar frame of claim 15, wherein said plurality of inflatable oar frame anchors comprise a plurality of anchor straps each fastenable between a pair of anchor strap fasteners correspondingly affixed to said inflatable oar frame body and said watercraft.

17. The inflatable oar frame of claim 1, further comprising a watercraft, wherein said inflatable oar frame body mounts over said watercraft interior of said watercraft.

18. The inflatable oar frame of claim 17, wherein said watercraft comprises an inflatable watercraft.

19. The inflatable oar frame of claim 17, wherein said watercraft comprises a non-inflatable watercraft.

20. The inflatable oar frame of claim 17, wherein said watercraft comprises an inflatable raft.

* * * * *